US010137909B2

(12) United States Patent
Mizufune et al.

(10) Patent No.: US 10,137,909 B2
(45) Date of Patent: Nov. 27, 2018

(54) AIR COMPRESSOR UNIT FOR VEHICLE

(71) Applicant: NABTESCO CORPORATION, Tokyo (JP)

(72) Inventors: Toru Mizufune, Hyogo (JP); Masaru Kuromitsu, Hyogo (JP); Akira Takahashi, Hyogo (JP); Tatsuo Miyauchi, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 14/704,370

(22) Filed: May 5, 2015

(65) Prior Publication Data

US 2015/0329125 A1 Nov. 19, 2015

(30) Foreign Application Priority Data

May 15, 2014 (JP) ..... 2014-101848

(51) Int. Cl.
*F01C 21/00* (2006.01)
*B61D 27/00* (2006.01)
*F04C 23/00* (2006.01)

(52) U.S. Cl.
CPC ..... *B61D 27/0072* (2013.01); *F01C 21/007* (2013.01); *F04C 23/005* (2013.01); *F04C 2230/60* (2013.01)

(58) Field of Classification Search
CPC ... F01C 21/007; B61D 27/0072; F01D 25/12; F04C 23/005; F04C 2230/60
See application file for complete search history.

(56) References Cited

U.S. PATENT DOCUMENTS 2,921,732 A * 1/1960 De Vin ..... F04B 49/007 417/288
4,725,210 A * 2/1988 Suzuki ..... F04C 29/04 418/101
4,929,161 A * 5/1990 Aoki ..... F04C 29/04 418/101
5,401,149 A 3/1995 Tsuru et al.
(Continued)

FOREIGN PATENT DOCUMENTS

CN 101344092 A 1/2009
CN 101421125 A 4/2009
(Continued)

OTHER PUBLICATIONS

Extended European Search Report as issued in European Patent Application No. 15166868.8, dated Oct. 29, 2015.
(Continued)

*Primary Examiner* — Devon Russell
(74) *Attorney, Agent, or Firm* — Pillsbury Winthrop Shaw Pittman, LLP

(57) ABSTRACT

An air compressor unit for vehicle (2) includes an air compressor (13) for compressing sucked air, an electric motor (14) for driving the air compressor (13), an after-cooler (17) for cooling compressed air generated in the air compressor (13) and an after-cooler cooling fan (18) for generating cooling air for the after-cooler (17) by being driven by a drive force of the electric motor (14). The air compressor (13) and the electric motor (14) are arranged one above the other.

13 Claims, 11 Drawing Sheets

(56) References Cited

U.S. PATENT DOCUMENTS 5,417,554 A * 5/1995 Kietzman ..... F04C 29/04 418/101
5,507,618 A * 4/1996 Kubo ..... F04C 29/04 165/47
5,613,843 A 3/1997 Tsuru et al.
6,027,311 A * 2/2000 Hill ..... F04B 39/06 165/103
6,109,897 A * 8/2000 Haga ..... F04C 29/04 418/101
6,190,145 B1 * 2/2001 Fujioka ..... F04C 29/04 417/371
6,193,486 B1 * 2/2001 Shiinoki ..... F04C 29/04 418/101
6,247,314 B1 6/2001 Biehler
6,357,242 B1 3/2002 Farley et al.
6,551,082 B2 * 4/2003 Douzono ..... F04C 29/04 418/201.1
7,329,108 B2 * 2/2008 Tsuchiya ..... F01C 1/0215 418/101
8,177,534 B2 * 5/2012 Ni ..... F04C 18/0253 418/101
8,221,094 B2 * 7/2012 Nishimura ..... F01C 21/007 417/243
8,562,317 B2 * 10/2013 Fujioka ..... F01C 1/0215 418/101
8,858,203 B2 * 10/2014 Kanaizumi ..... F04C 18/0215 418/55.1
9,115,719 B2 * 8/2015 Sadakata ..... F04C 29/04
9,328,731 B2 * 5/2016 Yabe ..... F04C 18/16
9,394,906 B2 * 7/2016 Fujimoto ..... F04C 18/16
2004/0211216 A1 * 10/2004 Yamasaki ..... F04C 18/3564 62/498
2004/0265146 A1 * 12/2004 Kagami ..... F01C 21/007 417/410.3
2005/0169788 A1 * 8/2005 Komai ..... F01C 21/10 418/55.6
2008/0206085 A1 * 8/2008 Zieglgansberger ..... F04C 29/04 418/85
2009/0004039 A1 1/2009 Ohtsuka et al.
2009/0016921 A1 1/2009 Fujimoto et al.
2009/0194177 A1 8/2009 Yokota et al.
2010/0122808 A1 * 5/2010 Hritz ..... F04B 53/08 165/287
2010/0135840 A1 * 6/2010 Fujimoto ..... F04B 39/0033 418/201.1
2011/0081262 A1 4/2011 Inoue et al.
2011/0300012 A1 12/2011 Fujioka et al.
2013/0136643 A1 * 5/2013 Yabe ..... F04C 29/04 418/83
2013/0269688 A1 10/2013 Attolini
2014/0314586 A1 * 10/2014 Kanaizumi ..... F04C 23/001 417/362
2016/0298629 A1 10/2016 Fujimoto et al.

FOREIGN PATENT DOCUMENTS

CN 102330570 A 1/2012
DE 20 2008 013 732 U1 2/2009
EP 0 587 157 A2 3/1994
EP 1174295 A2 1/2002
EP 1 500 819 A2 1/2005
EP 1 967 735 A1 9/2008
EP 2088320 A2 8/2009
JP S59-165951 A 9/1984
JP H10-030594 A 2/1998
JP 2004-332557 A 11/2004
JP 2005-076481 A 3/2005
JP 2005-207414 A 8/2005
JP 2007-270665 A 10/2007
JP 2009-068496 A 4/2009
JP 3150077 U 4/2009
JP 2010-077893 A 4/2010
JP 2011-153534 A 8/2011
JP 2011-169220 A 9/2011
JP 2012-012984 A 1/2012
JP 2013-068182 A 4/2013
WO WO 99/39101 A1 8/1999
WO WO 2004/101998 A1 11/2004
WO WO 2008/078159 A1 7/2008
WO WO 2012/085833 A1 6/2012

OTHER PUBLICATIONS

Notification of Reason for Refusal as issued in Korean Patent Application No. 10-2015-0066093, dated Oct. 10, 2016.
First Office Action as issued in Chinese Patent Application No. 201510246747.X, dated Nov. 1, 2016.
Communication pursuant to Article 94(3) EPC—EP Application No. 15 166 868.8 dated Oct. 25, 2017.
Notification of Reasons for Refusal Japanese Patent Application No. 2014-101848 dated Jan. 30, 2018 with English translation.
Office Action issued in Chinese Patent Application No. 201710182612.0 dated May 4, 2018 with partial English translation.
Communication pursuant to Article 94(3) EPC EP Application No. 15 166 868.8 dated Aug. 9, 2018.

* cited by examiner

AIR COMPRESSOR UNIT FOR VEHICLE

TECHNICAL FIELD

The present invention relates to an air compressor unit for vehicle to be mounted on a vehicle.

BACKGROUND ART

For example, a device mounted on a vehicle to generate compressed air to be used in the vehicle is known as disclosed in Japanese Utility Model Registration No. 3150077. The device disclosed in Japanese Utility Model Registration No. 3150077 includes a plurality of air compressors and a plurality of drive motors. Each air compressor is driven by each drive motor. Each air compressor is coupled in series to the corresponding drive motor. Note that each air compressor is configured as a scroll air compressor.

In the device disclosed in Japanese Utility Model Registration No. 3150077, the air compressors and the drive motors are coupled in series. Thus, a dimension of an air compressor unit including the air compressors and the drive motors becomes long. Then, an installation area required in mounting and installing this air compressor unit on a vehicle becomes long and wide.

The air compressor unit as described above is installed below a floor of the vehicle as also disclosed in Japanese Utility Model Registration No. 3150077. Thus, to install the above air compressor unit on the vehicle, a large and wide area is necessary below the floor of the vehicle. Further, even in the case of installing the above air compressor unit on a roof of the vehicle, a large and wide area is necessary on the roof of the vehicle. Accordingly, in the case of installing the above air compressor unit, it leads to an increase of the installation area on the vehicle. Further, in the case of installing a plurality of air compressor units in the vehicle, it leads to a further increase of the installation area.

SUMMARY OF INVENTION

The present invention aims to provide an air compressor unit for vehicle capable of a suppressing an increase of an installation area on a vehicle.

An air compressor unit for vehicle according to one aspect of the present invention is an air compressor unit for vehicle to be mounted on a vehicle and includes an air compressor for compressing sucked air and an electric motor for driving the air compressor. The air compressor and the electric motor are arranged one above the other.

DESCRIPTION OF EMBODIMENT

Hereinafter, one embodiment for carrying out the present invention is described with reference to the drawings. Note that this embodiment can be widely applied in relation to an air compressor unit for vehicle and an air compression apparatus for vehicle to be mounted on a vehicle.

Installation Mode of Air Compression Apparatus and Air Compressor Units

Figure 1:
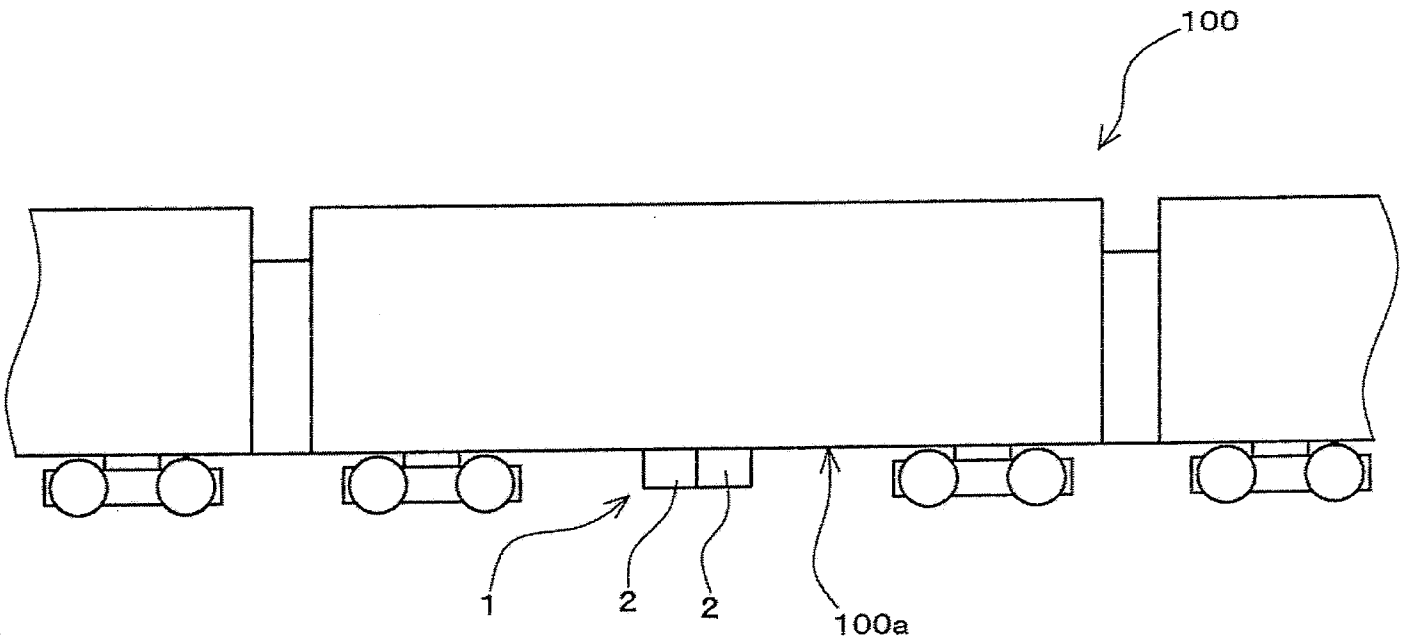
FIG. 1 is a diagram showing a state where an air compression apparatus for vehicle and air compressor units for vehicle according to one embodiment of the present invention are installed on a vehicle.
Figure 2:
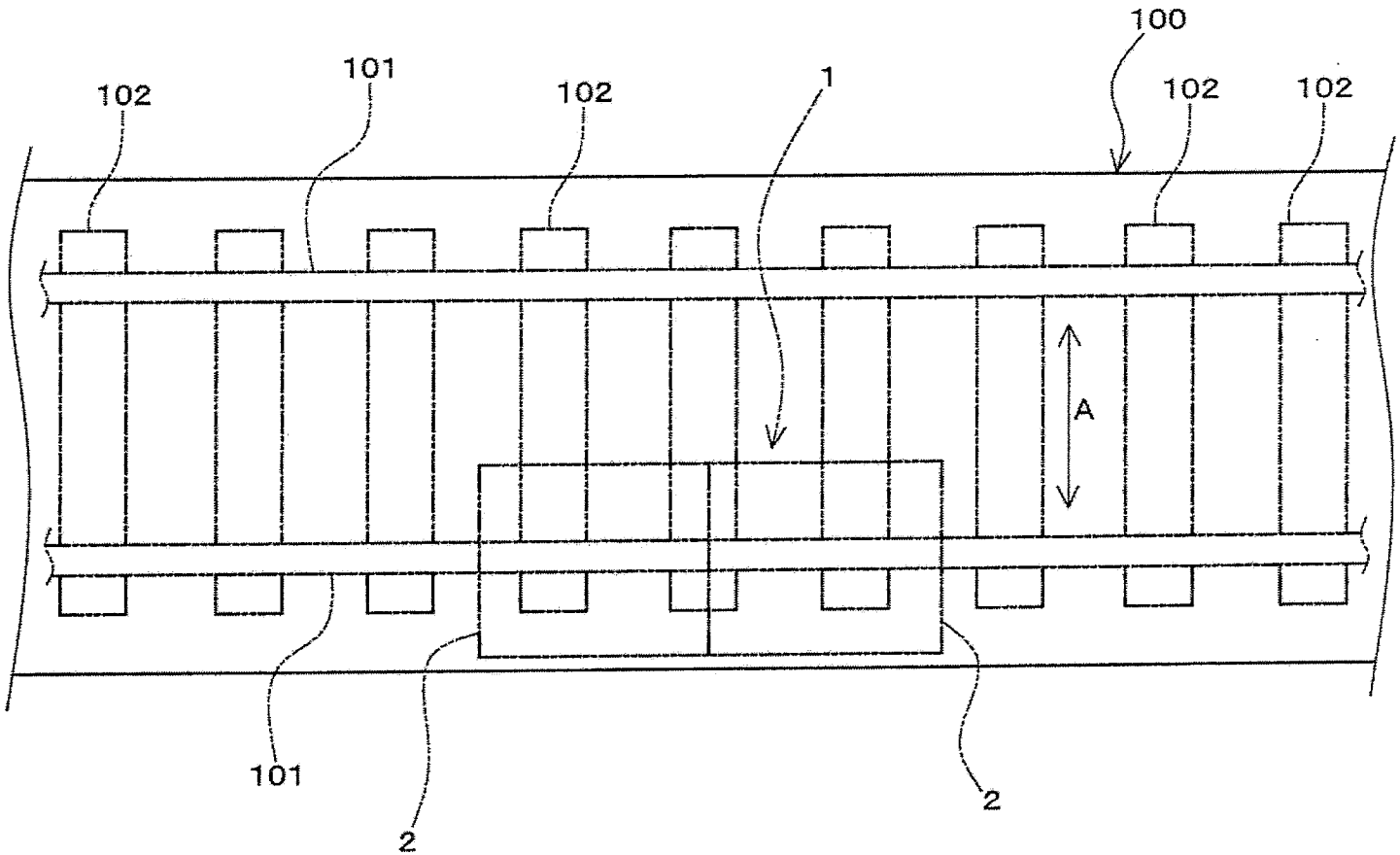
FIG. 2 is a plan view diagrammatically showing an installation position of the air compression apparatus and the air compressor units shown in FIG. 1 on the vehicle.

FIG. 1 is a diagram showing a state where an air compression apparatus for vehicle 1 and air compressor units for vehicle 2 according to one embodiment of the present invention are installed on a vehicle 100 configured as a railway vehicle. FIG. 2 is a plan view diagrammatically showing an installation position of the air compression apparatus for vehicle 1 and the air compressor units for vehicle 2 on the vehicle 100.

As shown in FIGS. 1 ad 2, the air compression apparatus for vehicle 1 includes a plurality of air compressor units for vehicle 2. The air compressor unit for vehicle 2 of this embodiment is also configured as an air compressor unit 2 to be provided in the air compression apparatus 1 for vehicle of this embodiment. Note that, in the following description, the air compression apparatus for vehicle 1 is also merely referred to as the "air compression apparatus 1". Further, the air compressor unit for vehicle 2 is also merely referred to as the "air compressor unit 2".

In this embodiment, the air compression apparatus 1 is illustrated to include two air compressor units 2. However, there is no need to have this configuration. The air compression apparatus 1 may include three or more air compressor units.

The air compression apparatus 1 and the air compressor units 2 are installed, for example, below a floor 100*a* of the vehicle 100 (see FIG. 1). The air compression apparatus 1 and the air compressor units 2 are mounted on the vehicle 100 to generate compressed air to be used in the vehicle 100. The compressed air generated in the air compression apparatus 1 and the air compressor units 2 is used to operate each pneumatic device mounted in the vehicle 100.

The plan view of FIG. 2 shows a state of a part of the vehicle 100 viewed from above. In FIG. 2, the air compression apparatus 1 and the air compressor units 2 installed below the floor 100*a* of the vehicle 100 are shown by chain double-dashed line. Further, rails 101 and crossties 102 of a track on which the vehicle 100 travels are also shown by chain double-dashed line in FIG. 2.

As shown in FIG. 2, the air compression apparatus 1 and the air compressor units 2 are installed at a position shifted toward one side from a widthwise center of the vehicle 100 in a width direction of the vehicle 100. Note that the width direction of the vehicle 100 is shown by a line A with arrows on both ends. The width direction of the vehicle 100 is a direction perpendicular to a traveling direction of the vehicle 100 and parallel to a longitudinal direction of the crossties 102 perpendicular to an extending direction of the rails 101.

Further, as shown in FIGS. 1 and 2, the plurality of (two in this embodiment) air compressor units 2 are installed below the floor 100*a* of the vehicle 100 while being juxtaposed in the traveling direction of the vehicle 100. Note that the installation mode of the air compression apparatus 1 and the air compressor units 2 shown in FIGS. 1 and 2 is an example.

Overall Configuration of Air Compression Apparatus

Figure 3:
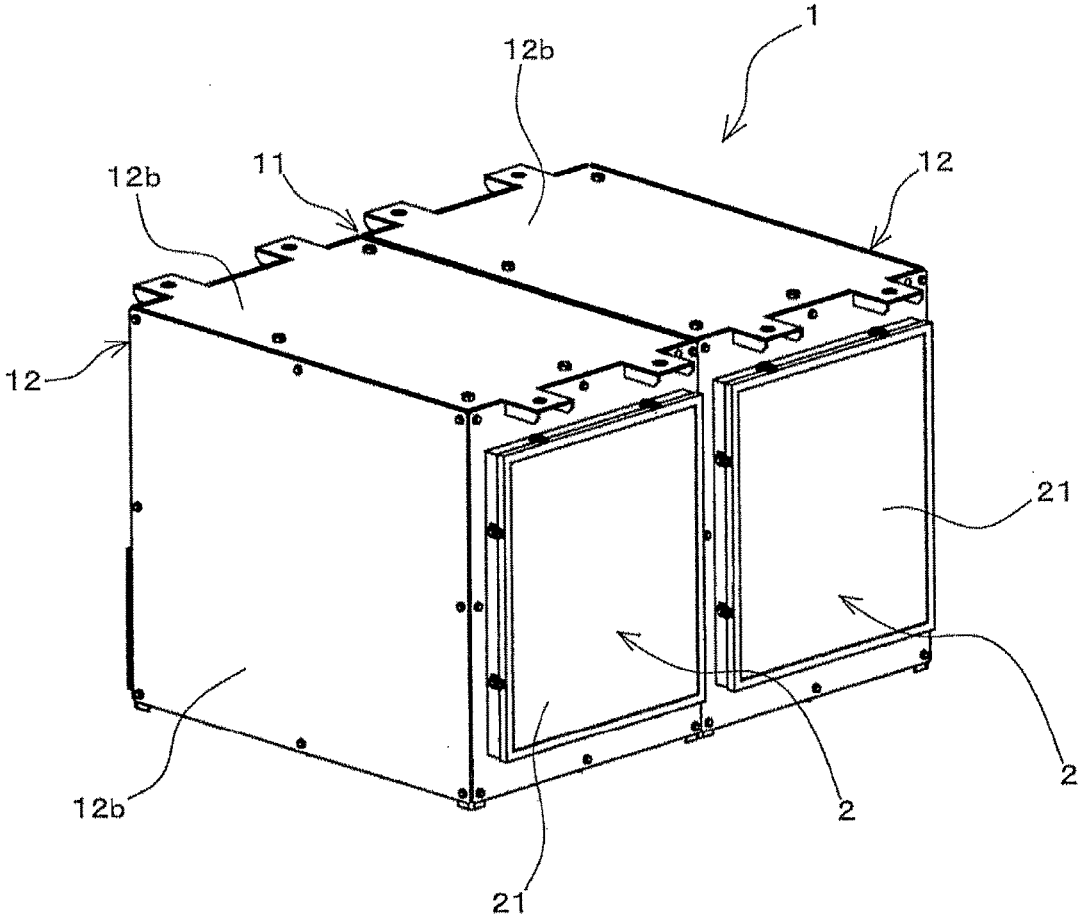
FIG. 3 is a perspective view showing the air compression apparatus and the air compressor units shown in FIG. 1.
Figure 4:
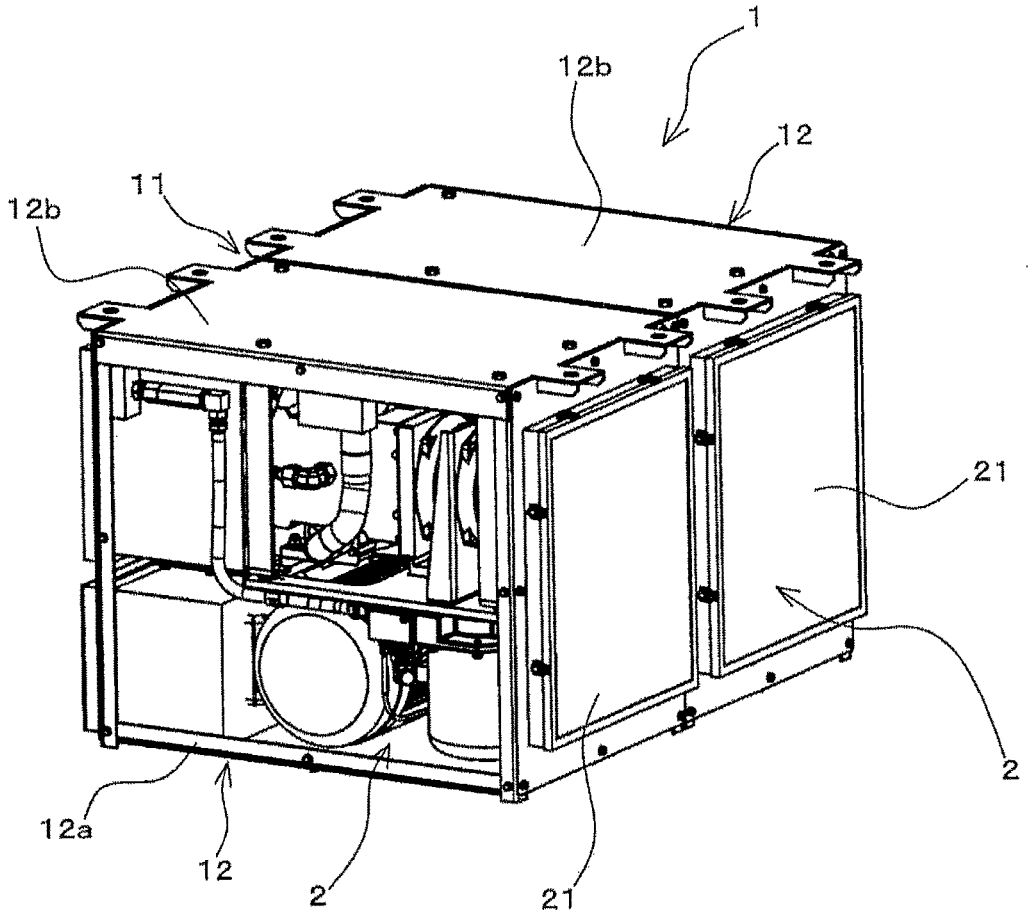
FIG. 4 is a perspective view of the air compression apparatus shown in FIG. 3 with some elements of the air compression apparatus omitted to enable parts of the air compressor unit arranged in the air compression apparatus to be seen.
Figure 5:
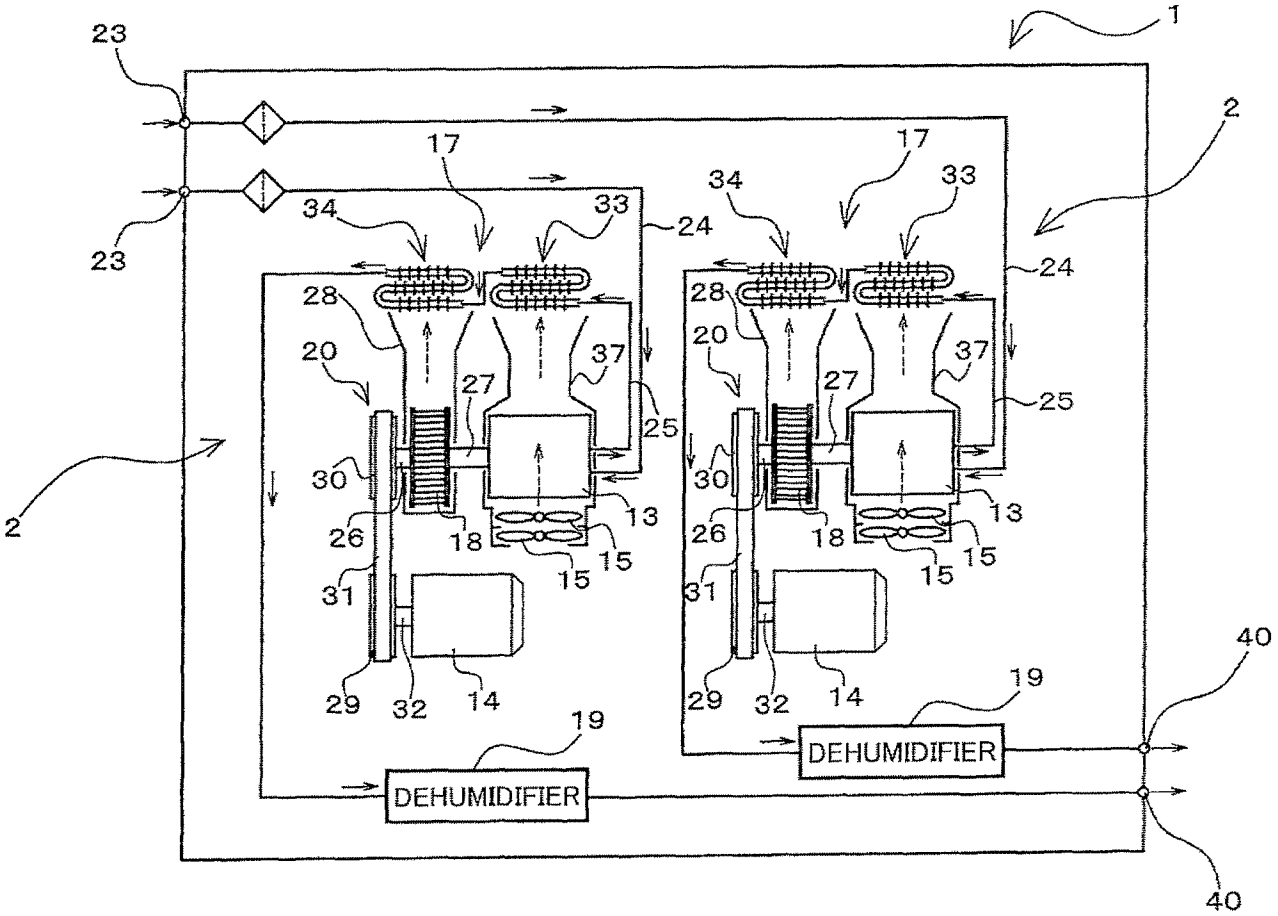
FIG. 5 is a diagram showing a system configuration of the air compression apparatus and the air compressor units shown in FIG. 3.

FIG. 3 is a perspective view showing the air compression apparatus 1 and the air compressor units 2. FIG. 4 is a perspective view of the air compression apparatus 1 with some elements of the air compression apparatus 1 omitted to enable parts of the air compressor unit 2 arranged in the air compression apparatus 1 to be seen. FIG. 5 is a diagram showing a system configuration of the air compression apparatus 1 and the air compressor units 2 shown in FIG. 3.

As shown in FIGS. 3 to 5, the air compression apparatus 1 includes the plurality of (two in this embodiment) air compressor units 2 and a case unit 11.

The case unit 11 includes a plurality of (two in this embodiment) individual cases 12. Each individual case 12 is configured as a housing for holding the air compressor unit 2. Each individual case 12 includes a frame body 12*a* assembled into a rectangular parallelepiped and a plurality of panel bodies 12*b* attached to the frame body 12*a*. The plurality of panel bodies 12*b* are so attached to the frame body 12*a* as to surround the air compressor unit 2. Note that, in FIG. 4, the air compression apparatus 1 is shown in a state where one panel body 12*b* is omitted in one of the plurality of individual cases 12.

The plurality of individual cases 12 each for holding the air compressor unit 2 are integrally fixed and installed on the vehicle 100 while being juxtaposed in a line. In this way, the case unit 11 is configured to be installable on the vehicle 100 while holding the plurality of air compressor units 2 juxtaposed in a line.

[Overall Configuration of Air Compressor Unit]

Figure 6:
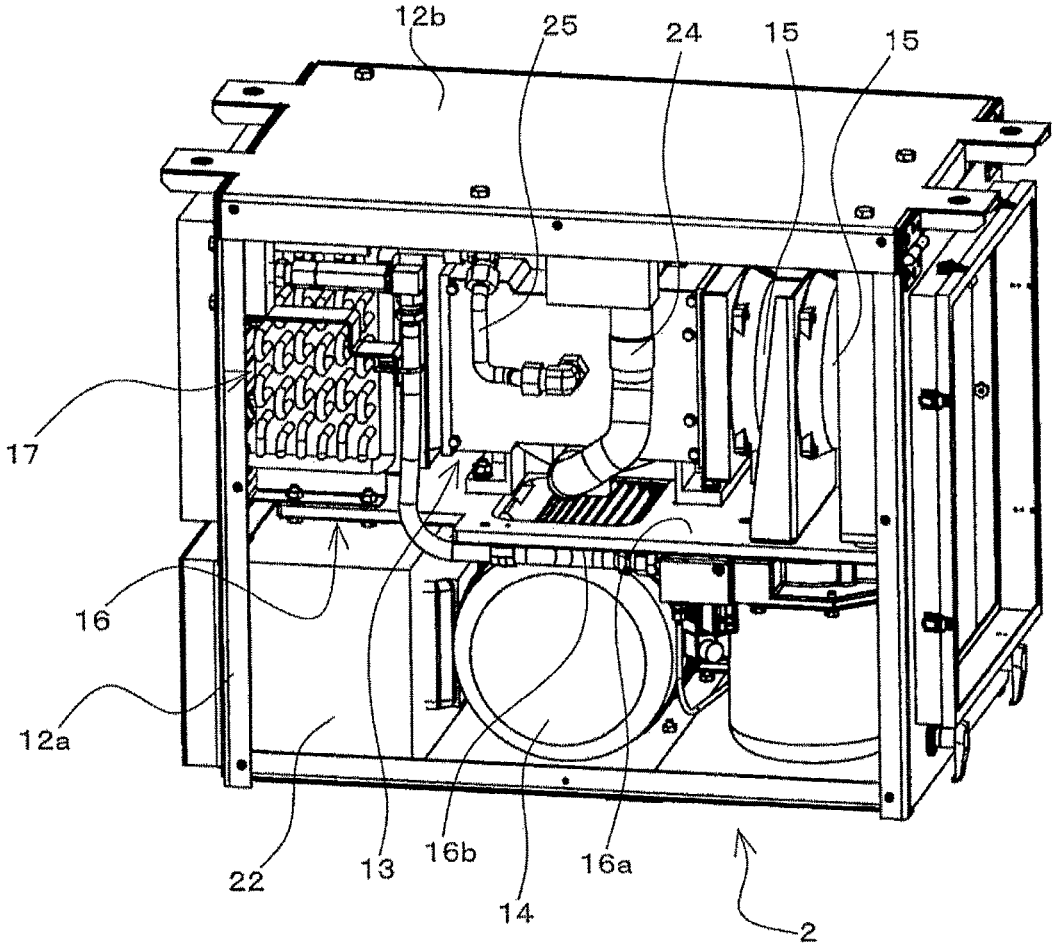
FIG. 6 is a perspective view of the air compressor unit shown in FIG. 4.
Figure 7:
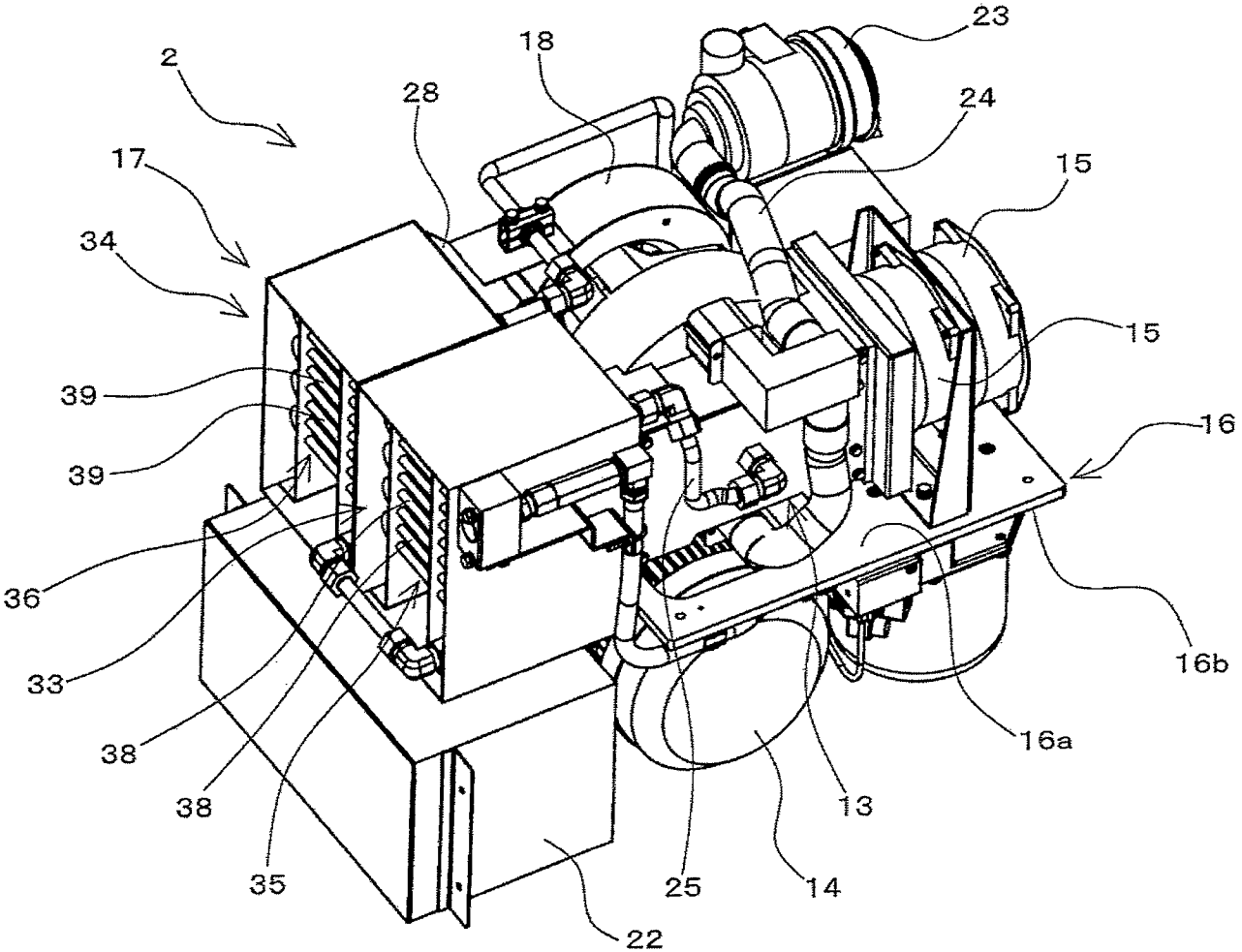
FIG. 7 is a perspective view showing the air compressor unit shown in FIG. 6 when viewed in a direction different from that in FIG. 6 with elements arranged around the air compressor unit omitted.
Figure 8:
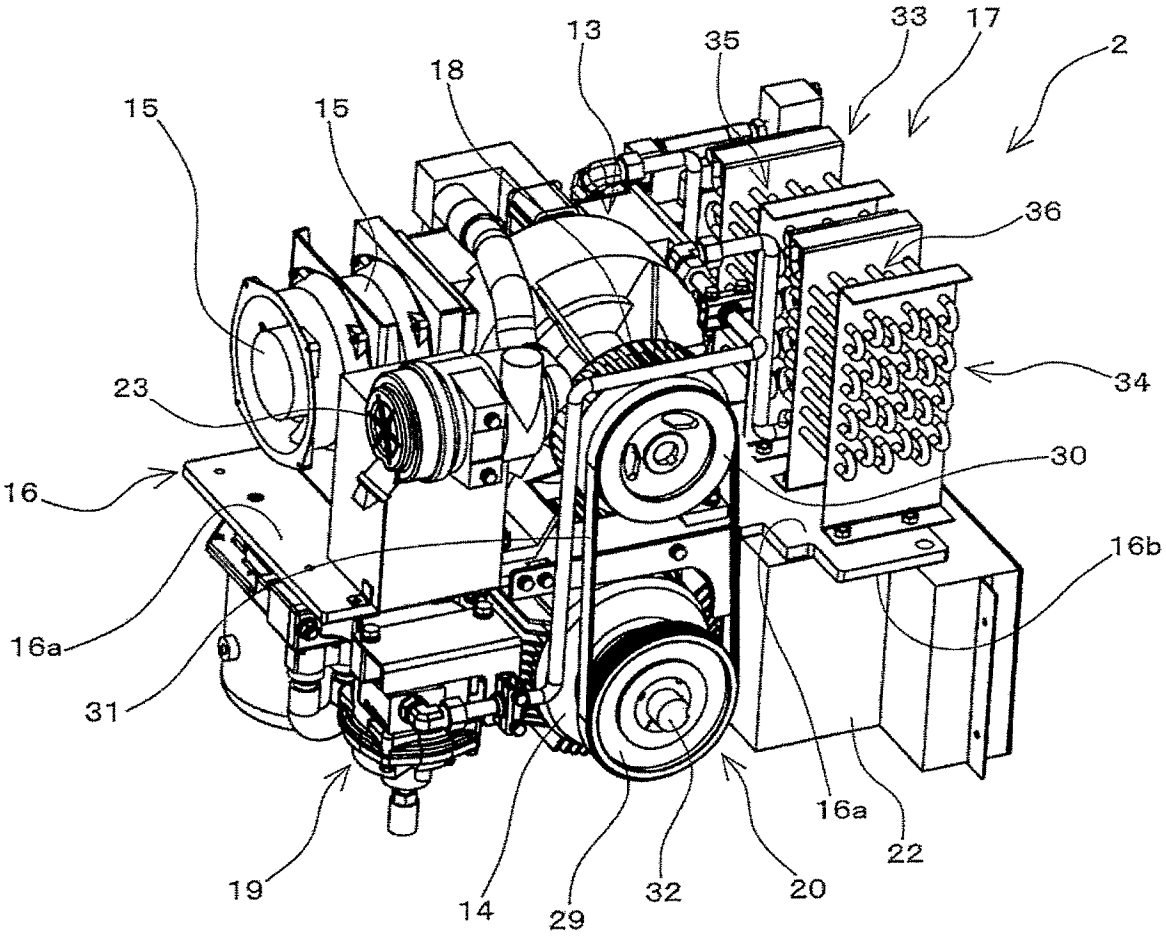
FIG. 8 is a perspective view showing the air compressor unit shown in FIG. 7 when viewed in a direction different from that in FIG. 7 with some elements omitted to enable an internal structure to be seen.

FIG. 6 is a perspective view showing one of the two air compressor units shown in FIG. 4. FIG. 7 is a perspective view showing the air compressor unit 2 shown in FIG. 6 when viewed in a direction different from that in FIG. 6. Note that, in the perspective view of FIG. 7, the air compressor unit 2 is shown with the individual case 12, which is an element arranged around the air compressor unit 2, omitted. FIG. 8 is a perspective view showing the air compressor unit 2 shown in FIG. 7 when viewed in a direction different from that in FIG. 7 with some elements omitted to enable an internal structure to be seen.

As shown in FIGS. 3 to 8, each of the plurality of (two in this embodiment) air compressor units 2 includes an air compressor 13, an electric motor 14, air compressor cooling fans 15, a base unit 16, an after-cooler 17, an after-cooler cooling fan 18, a dehumidifier 19, a drive force transmission unit 20, a filter unit 21, a controller 22 and the like. Note that the two air compressor units 2 are identically configured. Accordingly, one of the two air compressor units 2 is described below and repeated description on the other air compressor unit 2 is omitted.

[Air Compressor]

The air compressor 13 for compressing sucked air is configured as a scroll type air compressor including a swing scroll and a fixed scroll. Further, the air compressor 13 is configured as an oil-free type air compressor for compressing air without using oil.

A suction port as an inlet through which air is sucked in the air compressor 13 is connected to an air suction unit 23 via a suction pipe 24. The suction port communicates with outside through the suction pipe 24 and the suction unit 23. Outside air is sucked into the air compressor 13 via the air suction unit 23 and the suction pipe 24. Note that the air suction unit 23 is provided with a dust filter for suppressing the passage of dust such as sand dust when the sucked air passes.

The air compressor 13 is driven by a drive force from the electric motor 14. At this time, the swing scroll rotates while swinging relative to the fixed scroll. In this way, the air is compressed between the swing scroll and the fixed scroll. A discharge port as an outlet for discharging the compressed air in the air compressor 13 is connected to the after-cooler 17 via a discharge pipe 25. That is, the discharge port communicates with the after-cooler 17. The compressed air generated in the air compressor 13 is supplied to the after-cooler 17 via the discharge pipe 25. The discharge pipe 25 may be configured by a pipe formed of an elastic body such as Teflon (registered trademark) or by a copper pipe or a steel pipe. Note that, in this embodiment, not a pipe formed of an elastic body such as Teflon, but a steel pipe is used as the discharge pipe 25 connecting the air compressor 13 and the after-cooler 17.

Note that although the air compressor unit 2 including the air compressor 13 that is the scroll type air compressor is illustrated in this embodiment, a configuration different from this may be adopted. An air compressor unit including a screw type air compressor may be configured. Further, an air compressor unit may be configured which includes a reciprocating type air compressor to be driven by a reciprocating drive force transmitted thereto while being translated from a rotational drive force from the electric motor 14 via a crank shaft. Further, an air compressor unit may be configured which includes an oil type air compressor for compressing air using oil.

[Filter Unit]

The filter unit 21 is provided as a filter element through which air sucked into the air suction unit 23 and the air compressor cooling fans 15 to be described later passes. Foreign substances are removed when outside air passes through the filter unit 21. As shown in FIGS. 3 and 4, the filter unit 21 is attached to the individual case 12.

The filter unit 21 is configured, for example, by a metal plate with a plurality of holes. Alternatively, the filter unit 21 may be configured by a metal net. The filter unit 21 is attached to the individual case 12 in such a posture that a surface-like flat wide part of a metal plate or a metal net faces the air suction unit 23 and the air compressor cooling fans 15. Note that a state where the filter unit 21 is removed from the individual case 12 is shown in FIG. 6.

[Electric Motor, Controller]

The electric motor 14 shown in FIGS. 5 to 8 is provided as a drive source for driving the air compressor 13. The electric motor 14 drives the air compressor 13 via the drive force transmission unit 20 to be described later. Specifically, a drive force generated by the electric motor 14 is transmitted to the air compressor 13 via the drive force transmission unit 20. In this way, the swing scroll of the air compressor 13 is rotationally driven while being swung.

The controller 22 shown in FIGS. 6 to 8 is configured as a control device for controlling the drive of the electric motor 14 by supplying a current from a power supply (not shown) to the electric motor 14. The current supplied to the electric motor 14 and a number of revolutions (rotation speed) of the electric motor 14 are controlled by the controller 12.

[Air Compressor Cooling Fan]

The air compressor cooling fan 15 shown in FIGS. 5 to 8 is configured as a fan for cooling the air compressor 13. The cooling fan 15 is arranged laterally to the air compressor 13. The cooling fan 15 generates cooling air for the air compressor 13. The air compressor 13 arranged on a downstream side of the flow of that cooling air is cooled by the cooling air.

A plurality of the air compressor cooling fans 15 is provided. In this embodiment, two air compressor cooling fans 15 are provided. Each of the two air compressor cooling fans 15 is configured as an axial fan including a propeller which rotates about an axis. The two air compressor cooling fans 15 are driven by another electric motor provided separately from the electric motor 14. The two air compressor cooling fans 15 are arranged side by side in a line in the axial direction. Specifically, the respective air compressor cooling fans 15 are so arranged that axes of rotation are aligned on the same straight line.

Further, a cover surrounding the propellers in the air compressor cooling fans 15 is coupled to a cover for covering a main body part of the air compressor 13. In this way, the cooling air for the air compressor 13 generated by the air compressor cooling fans 15 is efficiently blown to the air compressor 13 and the air compressor 13 is efficiently cooled. Note that a flowing direction of the cooling air for the air compressor 13 and a flowing direction of cooling air for the after-cooler 17 generated by the after-cooler cooling fan 18 to be described later are shown by broken-line arrows in FIG. 5.

Note that although the air compressor unit 2 is illustrated to include two air compressor cooling fans 15 in this embodiment, a configuration different from this may be adopted. An air compressor unit may be configured which includes only one air compressor cooling fan 15. Further, an air compressor unit may be configured which includes three or more air compressor cooling fans 15.

[Base Unit]

The base unit 16 shown in FIGS. 6 to 8 is provided as a member to which the air compressor 13, the electric motor 14 and the like are mounted and fixed and configured, for example, by a steel-made member. In this embodiment, the base unit 16 is configured as a plate unit in the form of a flat plate.

The base unit 16 is configured by a flat and wide member and has a first surface 16*a* and a second surface 16*b* constituting opposite surfaces thereof. Specifically, the first and second surfaces 16*a*, 16*b* are configured as flat surfaces substantially parallel to each other.

The air compressor 13 is mounted and fixed to the first surface 16*a* of the base unit 16. On the other hand, the electric motor 14 is mounted and fixed to the second surface 16*b* of the base unit 16. The air compressor 13 and the electric motor 14 are arranged side by side along a vertical direction while vertically sandwiching the base unit 16. The air compressor unit 2 is installed on the vehicle 100 to have such an arrangement. If this state is viewed from above, at least a part of the electric motor 14 overlaps with the air compressor 13. Further, the air compressor 13 and the electric motor 14 in each of the plurality of air compressor units 2 are arranged side by side along the vertical direction while sandwiching the base unit 16. The case unit 11 and the plurality of air compressor units 2 are installed on the vehicle 100 to have such an arrangement. As just described, in the air compressor unit 2, the air compressor 13 and the electric motor 14 are arranged side by side along the vertical direction.

In the air compressor unit 2, the air compressor 13 and the electric motor 14 are separately arranged above and below the base unit 16. The air compressor cooling fans 15 provided laterally to the air compressor 13 to cool the air compressor 13 are arranged on the first surface 16*a* similarly to the air compressor 13. Specifically, the air compressor cooling fans 15 and the electric motor 14 are also separately arranged above and below the base unit 16. By the above arrangement, the air compressor 13 and the air compressor cooling fans 15 are thermally separated from the electric motor 14 by the base unit 16. Thus, according to the air compressor unit 2, it can be suppressed that heat generated by the electric motor 14 affects the cooling of the air compressor 13 by the air compressor cooling fans 15. Thus, cooling efficiency of the air compressor 13 by the air compressor cooling fans 15 can be improved.

Further, in the air compressor unit 2, the controller 22 is arranged laterally to the electric motor 14. In other words, the controller 22 is arranged at a side opposite to the side of the first surface 16*a* where the air compressor 13 is arranged (side of the second surface 16*b* where the electric motor 14 is arranged) with respect to the base unit 16. In this embodiment, the controller 22 is arranged on the side of the second surface 16*b* with respect to the base unit 16 in a state not fixed to the second surface 16*b* of the base unit 16. However, a configuration different from this may be adopted. The controller 22 may be arranged on the side of the second surface 16*b* with respect to the base unit 16 in a state fixed to the second surface 16*b* of the base unit 16.

Note that, in this embodiment, the air compressor 13 and the air compressor cooling fans 15 are arranged above the base unit 16 and the electric motor 14 and the controller 20 are arranged below the base unit 16 in a state where the air compressor unit 2 is installed on the vehicle 100. However, a configuration different from this may be adopted. The air compressor 13 and the air compressor cooling fans 15 may be arranged below the base unit 16 and the electric motor 14 and the controller 20 may be arranged above the base unit 16 in the state where the air compressor unit 2 is installed on the vehicle 100.

[After-Cooler Cooling Fan]

The after-cooler cooling fan 18 shown in FIGS. 5, 7 and 8 is configured as a blower to be driven by a drive force of the electric motor 14. In this embodiment, the after-cooler cooling fan 18 is configured as a centrifugal blower. More specifically, the cooling fan 18 is configured as a sirocco fan. The after-cooler cooling fan 18 generates cooling air flow for the after-cooler 17 to be described later and cools the after-cooler 17 from outside. Note that, as described above, the flowing direction of the cooling air for the after-cooler 17 is shown by broken-line arrows in FIG. 5.

The after-cooler cooling fan 18 is adjacent to the air compressor 13 in a direction perpendicular to an axial direction of the air compressor cooling fans 15. In the air compressor unit 2, a rotary shaft 26 of the after-cooler cooling fan 18 and a rotary shaft 27 of the air compressor 13 are coaxially provided (see FIG. 5). Specifically, the rotary shafts 26, 27 are arranged side by side in a line and provided to integrally rotate. Further, an air suction side of the after-cooler cooling fan 18 is provided near the rotary shaft 27 of the air compressor 13. Thus, in the air compressor unit 2, the air compressor 13 is provided adjacent to the air suction side of the after-cooler cooling fan 18. A blowout port of the after-cooler cooling fan 18 is a direction parallel to a blowout direction of the air compressor cooling fans 15.

When the after-cooler cooling fan 18 is driven by the drive force of the electric motor 14, air near the rotary shaft 27 of the air compressor 13 is sucked into the after-cooler cooling fan 18 from the suction side in a central side of the after-cooler cooling fan 18 by a negative pressure generated by the rotation of the after-cooler cooling fan 18. The air sucked into the after-cooler cooling fan 18 flows toward a radially outer side of the after-cooler cooling fan 18 by the rotation of the after-cooler cooling fan 18. The cooling air generated by the after-cooler cooling fan 18 is guided by a duct 28. The cooling air guided by the duct 28 is blown to the after-cooler 17 to be described later to cool the after-cooler 17 (see FIGS. 5 and 7). Note that the duct 28 and a cover of the after-cooler cooling fan 18 are not shown in FIG. 8.

[Drive Force Transmission Unit]

The drive force transmission unit 20 shown in FIGS. 5 and 8 is provided as a mechanism for transmitting a drive force generated by the electric motor 14 to the after-cooler cooling fan 18 and the air compressor 13 and driving the after-cooler cooling fan 18 and the air compressor 13. The drive force transmission unit 20 includes a drive pulley 29, a driven pulley 30 and a drive belt 31.

The drive pulley 29 is configured to integrally rotate with a rotary shaft 32 of the electric motor 14. The driven pulley 30 is coupled to the rotary shaft 26 of the after-cooler cooling fan 18. The drive belt 31 is wound on the drive pulley 29 and the driven pulley 30 to rotate and configured as an endless belt for transmitting the drive force of the electric motor 14 to the after-cooler cooling fan 18 and the air compressor 13.

When the operation of the electric motor 14 is started to rotate the rotary shaft 32 of the electric motor 14, the drive pulley 29 rotates together with the rotary shaft 32. With the rotation of the drive pulley 29, the drive belt 31 rotates to rotate the driven pulley 30. This causes the rotary shaft 26 of the after-cooler cooling fan 18 to rotate together with the driven pulley 30, whereby the after-cooler cooling fan 18 operates. Further, as described above, the rotary shaft 26 of the after-cooler cooling fan 18 and the rotary shaft 27 of the air compressor 13 are coupled. Thus, the rotary shaft 27 of the air compressor 13 also rotates together with the rotary shaft 26 of the after-cooler cooling fan 18. Specifically, the air compressor 13 operates together with the after-cooler cooling fan 18.

[After-Cooler]

The after-cooler 17 shown in FIGS. 5 to 8 is provided as a mechanism for cooling the compressed air generated in the air compressor 13. As described above, the after-cooler 17 is connected to the air compressor 13 via the discharge pipe 25. The after-cooler 17 cools the compressed air generated in the air compressor 13 and supplied via the discharge pipe 25. As shown in FIGS. 6 to 8, the after-cooler 17 is fixed and mounted on the first surface 16*a* with respect to the base unit 16.

As shown in FIGS. 5, 7 and 8, the after-cooler 17 includes a first cooler unit 33 and a second cooler unit 34.

The first cooling unit 33 includes a first flow passage 35. The compressed air generated in the air compressor 13 flows in the first flow passage 35. This compressed air is cooled by the cooling air flow generated by the air compressor cooling fans 15. Further, the first cooling unit 33 (after-cooler 17) is arranged at a side opposite to the air compressor cooling fans 15 with respect to the air compressor 13. Specifically, the first cooling unit 33 (after-cooler 17) is arranged on an extension line of the rotary shaft of the cooling fans 15. The first cooling unit 33 is arranged downstream of the air compressor 13 in a flowing direction of the cooling air generated by the air compressor cooling fans 15 and blown toward the air compressor 13.

By the above configuration, the cooling air generated by the air compressor cooling fans 15 and having cooled the air compressor 13 cools the first flow passage 35 of the first cooling unit 33 from outside. Then, the compressed air flowing in the first flow passage 35 is cooled by the cooled first flow passage 35. Note that a duct 37 is disposed around an area downstream of the air compressor 13 in the flowing direction of the cooling air generated by the air compressor cooling fans 15 and having cooled the air compressor 13 (see FIG. 5). The duct 37 is provided to guide the cooling air generated by the air compressor cooling fans 15 and having cooled the air compressor 13 to the first cooling unit 33.

The second cooling unit 34 is connected to the first cooling unit 33. The second cooling unit 34 includes a second flow passage 36 into which the compressed air cooled by the first cooling unit 33 after being compressed by the air compressor 13 flows. Specifically, the second flow passage 36 is connected to a downstream side of the first flow passage 33.

Further, the second cooling unit 34 is cooled by the cooling air flow generated by the after-cooler cooling fan 18. Specifically, the cooling air generated by the after-cooler cooling fan 18 cools the second flow passage 36 of the second cooling unit 34 from outside. Then, the compressed air flowing in the second flow passage 36 is cooled by the cooled second flow passage 36. Thus, the compressed air generated by the air compressor 13 is first cooled in the first cooling unit 33 and then in the second cooling unit 34.

Further, the first cooling unit 33 is arranged laterally to the air compressor 13 and the second cooling unit 34 is arranged laterally to the after-cooler cooling fan 18. Note that, in this embodiment, the first and second cooling units 33, 34 are arranged side by side along a horizontal direction in the state where the air compressor unit 2 is installed on the vehicle 100. Further, the first and second cooling units 33, 34 are arranged side by side along the horizontal direction in each of the plurality of air compressor units 2 in the state where the case unit 11 and the plurality of air compressor units 2 are installed on the vehicle 100.

Figure 9:
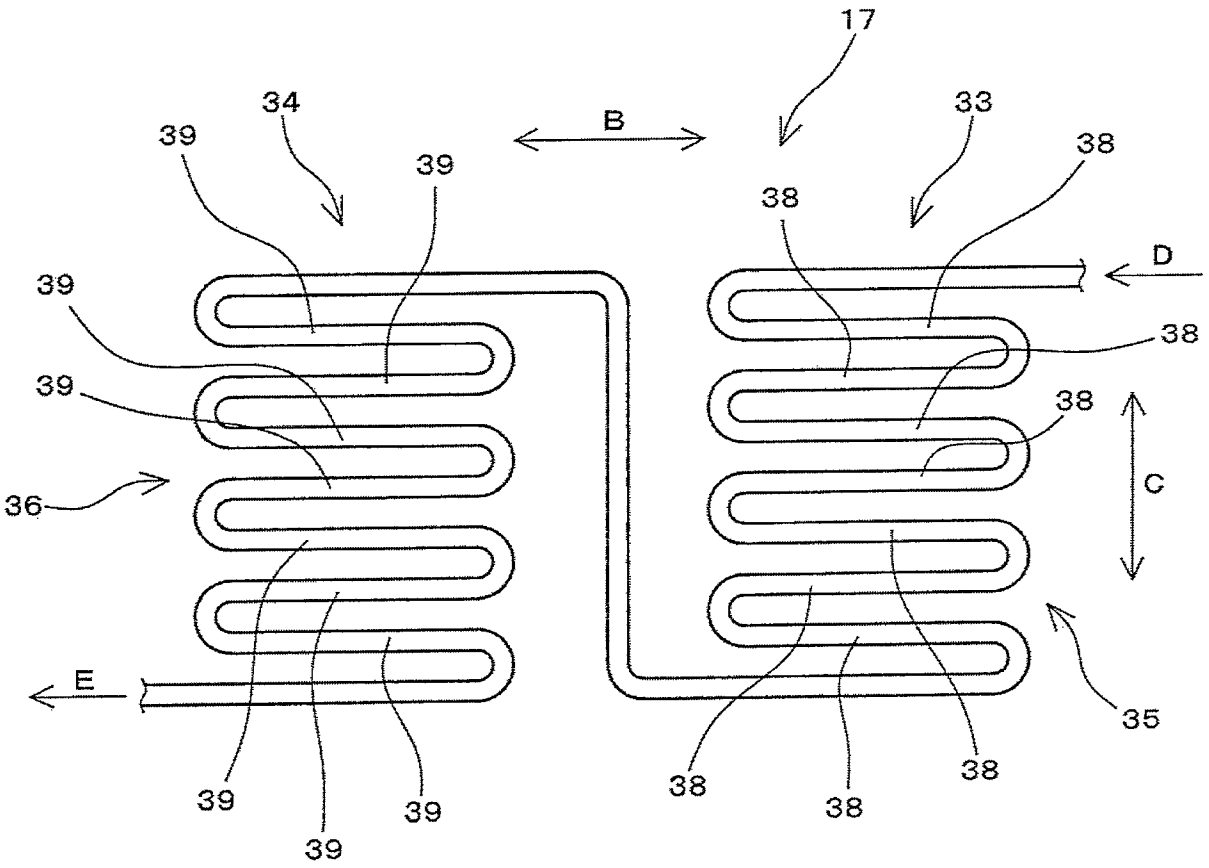
FIG. 9 is a view of a cooler of the air compressor unit shown in FIGS. 6 to 8 diagrammatically showing a flow passage configuration for compressed air in the cooler.

Here, the configurations of the first and second flow passages 35, 36 are described in more detail. FIG. 9 is a view of the after-cooler 17 of the air compressor unit 2 shown in FIGS. 6 to 8 diagrammatically showing a flow passage configuration for the compressed air in the after-cooler 17.

As shown in FIGS. 7 and 9, the first flow passage 35 includes a plurality of first horizontal flow passages 38 extending along the horizontal direction in the state where the air compressor unit 2 is installed on the vehicle 100. The first flow passage 35 is configured to meander along the horizontal direction by connecting the plurality of first horizontal flow passages 38 via U-shaped portions.

The second flow passage 36 includes a plurality of second horizontal flow passages 39 extending along the horizontal direction in the state where the air compressor unit 2 is installed on the vehicle 100. The second flow passage 36 is configured to meander along the horizontal direction by connecting the plurality of second horizontal flow passages 39 via U-shaped portions.

Note that the horizontal direction in the state where the air compressor unit 2 is installed on the vehicle 100 is shown by a line B with arrows on both ends in FIG. 9. Further, a vertical direction in the state where the air compressor unit 2 is installed on the vehicle 100 is shown by a line C with arrows on both ends in FIG. 9. Furthermore, a flowing direction of the compressed air flowing into the first flow passage 35 is shown by an arrow D and that of the compressed air flowing out of the second flow passage 36 is shown by an arrow E in FIG. 9.

As shown in FIG. 9, the plurality of first horizontal flow passages 38 are successively connected via bent flow passages. The plurality of second horizontal flow passages 39 are successively connected via bent flow passages. The plurality of first horizontal flow passages 38 are arranged in a row or in a plurality of rows along the vertical direction in the state where the air compressor unit 2 is installed on the vehicle 100. Similarly, the plurality of second horizontal flow passages 39 are arranged in a row or in a plurality of rows along the vertical direction in the state where the air compressor unit 2 is installed on the vehicle 100.

Note that, in this embodiment, the plurality of first horizontal flow passages 38 are arranged in a plurality of rows along the vertical direction in the state where the air compressor unit 2 is installed on the vehicle 100. Specifically, there are a plurality of rows of the first horizontal flow passages 38 arranged side by side along the vertical direction and the plurality of rows are arranged side by side in the horizontal direction. In the first flow passage 35, the compressed air is cooled successively in the first horizontal flow passages 38 in each row.

Further, in this embodiment, the plurality of second horizontal flow passages 39 are arranged in a plurality of rows along the vertical direction in the state where the air compressor unit 2 is installed on the vehicle 100. Specifically, there are a plurality of rows of the second horizontal flow passages 39 arranged side by side along the vertical direction and the plurality of rows are arranged side by side in the horizontal direction. In the second flow passage 36, the compressed air is cooled successively in the second horizontal flow passages 39 in each row.

Note that, in the diagram of FIG. 9, a state where the plurality of first horizontal flow passages 38 are arranged side by side in the vertical direction in one row is shown to facilitate the description of the state where the plurality of first horizontal flow passages 38 are arranged side by side along the vertical direction. Similarly, in the diagram of FIG. 9, a state where the plurality of second horizontal flow passages 39 are arranged side by side in the vertical direction in one row is shown to facilitate the description of the state where the plurality of second horizontal flow passages 39 are arranged side by side along the vertical direction.

[Dehumidifier]

The dehumidifier 19 shown in FIGS. 5 to 8 is provided as a mechanism for dehumidifying the compressed air generated by the air compressor 13 and cooled by the after-cooler 17. The dehumidifier 19 is connected to a downstream side of the second cooling unit 34 and configured such that the compressed air cooled in the second cooling unit 34 flows thereinto. Further, the dehumidifier 19 is also connected to a compressed air feeding unit 40 for feeding the compressed air generated in the air compressor unit 2 to outside. Note that the compressed air fed from the compressed air feeding unit 40 is supplied to an accumulator (not shown) installed outside the case unit 11 to store the compressed air.

By the above configuration, the compressed air cooled in the second cooling unit 34 and having flowed into the dehumidifier 19 is first dehumidified in the dehumidifier 19. Subsequently, the compressed air dehumidified in the dehumidifier 19 is fed from the compressed air feeding unit 40 and supplied to the accumulator.

[Operations of Air Compression Apparatus and Air Compressor Units]

Next, the operations of the air compression apparatus 1 and the air compressor units 2 described above are described. By operating each of the plurality of air compressor units 2, the air compression apparatus 1 operates. Note that flows of air during the operations of the air compression apparatus 1 and the air compressor units 2 are shown by solid-line arrows in the diagram of FIG. 5.

In a state where the air compression apparatus 1 and the air compressor units 2 are operating, air as outside air is sucked into the air suction unit 23 by a negative pressure generated by the operation of the air compressor 13. The air compressor 13 operates by the operation of the electric motor 14 operated by the control of the controller 22. Further, the air compressor 13 is cooled by the cooling air flow generated by the air compressor cooling fans 15.

The air sucked into the air suction unit 23 flows into the air compressor 13 and compressed in the air compressor 13. The air (compressed air) compressed in the air compressor 13 flows into the after-cooler 17 and cooled in the after-cooler 17. At this time, the compressed air first passes in the first flow passage 35 of the first cooling unit 33 cooled from outside by the cooling air generated by the air compressor cooling fans 15 and having cooled the air compressor 13. In this way, the compressed air is cooled in the first flow passage 35. Subsequently, the compressed air cooled in the first cooling unit 35 passes in the second flow passage 36 of the second cooling unit 34 cooled from outside by the cooling air generated by the after-cooler cooling fan 18. In this way, the compressed air is cooled in the second flow passage 36.

The compressed air cooled in the after-cooler 17 flows into the dehumidifier 19 and dehumidified in the dehumidifier 19. The compressed air dehumidified in the dehumidifier 19 is fed from the compressed air feeding unit 40 and supplied to the accumulator.

[Functions and Effects of Air Compressor Unit]

As described above, in this embodiment, the air compressor unit for vehicle 2 is so mounted and installed on the vehicle 100 that the air compressor 13 and the electric motor 14 are arranged along the vertical direction. This efficiently suppresses the extension and expansion of an installation area necessary in mounting and installing the air compressor unit for vehicle 2 on the vehicle 100. In this way, an increase of the installation area of the air compressor unit for vehicle 2 on the vehicle 100 is suppressed. Further, an increase of the installation area in installing a plurality of air compressor units for vehicle 2 on the vehicle 100 is also suppressed.

Thus, according to this embodiment, it is possible to provide the air compressor unit for vehicle 2 capable of suppressing an increase of the installation area on the vehicle 100. Since an increase of the installation area on the vehicle 100 is suppressed according to this embodiment, a degree of freedom in rigging the air compressor unit for vehicle 2 on the vehicle 100 can be improved.

Further, in the air compressor unit for vehicle 2, the after-cooler cooling fan 18 for generating the cooling air for the after-cooler 17 for cooling the compressed air generated in the air compressor 13 is driven by the drive force of the electric motor 14. Thus, the after-cooler cooling fan 18 can be driven by efficiently utilizing power of the electric motor 14. Further, since it is not necessary to separately provide a drive source for the after-cooler cooling fan 18, the structure of the air compressor unit for vehicle 2 as a whole can be compacted and the installation area can be drastically reduced.

Further, in the air compressor unit for vehicle 2, the air suction port of the after-cooler cooling fan 18 is facing toward the air compressor 13. Thus, the after-cooler cooling fan 18 generates the flow of air around the air compressor 13 adjacent to the air suction side of the after-cooler cooling fan 18 in sucking surrounding air. As a result, the air compressor 13 is cooled. Thus, a configuration for cooling the air compressor 13 can be realized by a compact structure. Then, the structure of the air compressor unit for vehicle 2 as a whole can be compacted and the installation area can be drastically reduced.

Further, in the air compressor unit for vehicle 2, the rotary shaft 26 of the after-cooler cooling fan 18 and the rotary shaft 27 of the air compressor 13 are coaxially provided. Thus, a power transmission mechanism such as a gear is not necessary. Therefore, the structure of the air compressor unit for vehicle 2 as a whole can be compacted and the installation area can be drastically reduced.

Further, in the air compressor unit for vehicle 2, the after-cooler cooling fan 18 is configured as a centrifugal blower capable of easily generating a large air flow. Thus, the after-cooler 17 can be efficiently cooled by the after-cooler cooling fan 18 as the centrifugal blower. By efficiently cooling the after-cooler 17, the compressed air generated in the air compressor 13 can be efficiently cooled.

Note that, according to the air compressor unit for vehicle 2, the air compressor 13 can be efficiently cooled by the air compressor cooling fans 15 and the after-cooler 17 can be efficiently cooled by the after-cooler cooling fan 18. By being able to efficiently cool the after-cooler 17, the compressed air generated in the air compressor 13 can be efficiently cooled. For example, according to a result of a measurement conducted under predetermined conditions, it was confirmed that the compressed air could be cooled to about 40° C. by the air compressor unit for vehicle 2 when the temperature of the compressed air discharged from the air compressor 13 was about 250° C.

Further, in the air compressor unit for vehicle 2, the rotary shafts (26, 27) of the after-cooler cooling fan 18 as the centrifugal blower and the air compressor 13 are coaxially provided. Thus, the after-cooler 17 can be arranged laterally to, above or below the after-cooler cooling fan 18 and the air compressor 13. Note that, in this embodiment, the after-cooler 17 is arranged laterally to the after-cooler cooling fan 18 and the air compressor 13. Thus, a duct for guiding the cooling air from the after-cooler cooling fan 18 to the after-cooler 17 can be shortened in length. In this way, the structure of the air compressor unit for vehicle 2 as a whole can be compacted and the installation area can be drastically reduced.

Further, in the air compressor unit for vehicle 2, the rotary shaft 26 of the after-cooler cooling fan 18 configured as the centrifugal blower and the rotary shaft 27 of the air compressor 13 are coaxially provided. Thus, air near the rotary shaft 27 of the air compressor 13 warmed by heat generated by the air compressor 13 is easily sucked into the after-cooler cooling fan 18. In this way, it can be suppressed that devices such as a bearing mounted on the rotary shaft 27 of the air compressor 13 are heated by the heat generated by the air compressor 13. Further, the scroll type air compressor including the swing scroll and the fixed scroll is used as the air compressor 13. In this case, the after-cooler cooling fan 18 that is the centrifugal blower can be arranged at a swing scroll side of the fixed scroll. Then, the rotary shaft 26 of the after-cooler cooling fan 18 and the rotary shaft 27 of the air compressor 13 can be coaxially provided. When the air compressor unit for vehicle 2 is configured as in this embodiment, it can be suppressed that the devices such as a bearing mounted on the rotary shaft 27 of the air compressor 13 and provided on the swing scroll side are heated.

Further, according to the air compressor unit for vehicle 2, the air compressor cooling fans 15 are configured as axial fans provided laterally to the air compressor 13. The axial fans are configured as fans smaller in size than the centrifugal blower. Thus, even if a space for installing the air compressor cooling fans 15 of the air compressor unit for vehicle 2 is narrow, the air compressor cooling fans 15 can be easily installed. Further, the miniaturization of the air compressor unit for vehicle 2 including the air compressor cooling fans 15 can also be realized. Note that it is also thought to provide a centrifugal blower to be driven by the drive force of the electric motor 14 for driving the air compressor 13 and cool the air compressor 13 by air blown from this centrifugal blower. However, in this case, cooling air from the centrifugal blower needs to be guided to the air compressor 13 via a bent duct. Thus, a pressure loss may be created and cooling efficiency may be reduced. However, if the air compressor cooling fans 15 are configured as the axial fans provided laterally to the air compressor 13, the bent duct is not necessary. As a result, the air compressor 13 can be efficiently cooled. Further, if the air compressor cooling fans 15 are axial fans, they are driven by the electric motor provided separately from the electric motor 14 for driving the air compressor 13. Thus, even if the operation of the air compressor 13 is stopped, the air compressor 13 can be cooled by the air compressor cooling fans 15.

Further, in the air compressor unit for vehicle 2, the compressed air generated in the air compressor 13 and having a relatively high temperature is cooled in the first cooling unit 33. The first cooling unit 33 is cooled by the cooling air coming from the air compressor cooling fans 15 that are the axial fans, having cooled the air compressor 13 and having a relatively high temperature. Subsequently, the compressed air cooled in the first cooling unit 33 is cooled in the second cooling unit 34. The second cooling unit 34 is cooled by the cooling air having a low temperature from the after-cooler cooling fan 18 that is the centrifugal blower. Thus, cooling by the cooling air from the air compressor cooling fans 15 and cooling by the cooling air from the after-cooler cooling fan 18 are successively performed in this order and the compressed air is efficiently cooled. Further, according to this embodiment, the first cooling unit 33 is arranged laterally to the air compressor 13 and the second cooling unit 34 is arranged laterally to the after-cooler cooling fan 18. Thus, the air compressor 13, the after-cooler cooling fan 18 and the after-cooler 17 can be arranged in a compact manner. Furthermore, according to this embodiment, the cooling air from the axial fans for cooling the air compressor 13 can be used to cool the after-cooler 17. Thus, cooling performance of the after-cooler cooling fan 18 can be set low, wherefore the miniaturization of the after-cooler cooling fan 18 can also be realized. These enable the structure of the air compressor unit for vehicle 2 as a whole to be compacted and the installation area to be drastically reduced.

Note that if the flow passage configuration of the after-cooler 17 is such that cooling by the cooling air from the air compressor cooling fans 15 and cooling by the cooling air from the after-cooler cooling fan 18 are alternately repeated, a state may occur where the compressed air temporarily cooled is warmed and cooled again. In this case, cooling efficiency in cooling the compressed air may be reduced. However, according to this embodiment, the compressed air can be efficiently cooled since there is no possibility of causing such a reduction in cooling efficiency.

Further, according to the air compressor unit for vehicle 2, the first flow passage 35 that is a flow passage for the compressed air in the first cooling unit 33 is provided to meander along the horizontal direction. Similarly, the second flow passage 36 that is a flow passage for the compressed air in the second cooling unit 34 is provided to meander along the horizontal direction. Thus, according to this embodiment, water droplets easily flow in the flow passage and are easily discharged to a downstream side even if dew condensation occurs in the flow passage and water droplets are produced in the flow passage. Thus, a configuration capable of suppressing the remaining of water droplets in the flow passage can be easily realized by a simple structure in the first and second cooling units 33, 34.

Further, according to the air compressor unit for vehicle 2, the air compressor 13 and the electric motor 14 are arranged one above the other and the controller 22 for the electric motor 14 is arranged laterally to the electric motor 14. Thus, the controller 22 can be arranged at a distance from the air compressor 13 and it can be suppressed that the heat generated from the air compressor 13 affects the controller 22. Furthermore, the electric motor 14 and the controller 22 can be arranged proximate to each other. Thus, a structure can be compacted by proximately arranging the electric motor 14 and the controller 22 while the air compressor 13 and the controller 22 are thermally separated.

Further, in the air compressor unit for vehicle 2, the after-cooler 17 that does not generate vibration is also mounted on the base unit 16 together with the air compressor 13 and the electric motor 14 serving as vibration generation sources. Thus, the air compressor 13, the electric motor 14, the after-cooler 17 and the base unit 16 are integrally fixed. Specifically, the air compressor 13, the electric motor 14, the after-cooler 17 and the base unit 16 are integrated into a structure. Thus, the air compressor 13, the electric motor 14, the after-cooler 17 and the base unit 16 have substantially the same natural frequency and substantially the same vibration mode. In this way, not a pipe configured by an elastic body such as Teflon, but a steel pipe available at low cost can be used as the pipe for the flow of the compressed air connecting the air compressor 13 and the after-cooler 17. Specifically, a steel pipe can be used as the discharge pipe 25. Further, according to this embodiment, the after-cooler 17 is mounted on the first surface 16*a* of the base unit 16 similarly to the air compressor 13. Thus, the air compressor 13 and the after-cooler 17 can be easily connected by the short discharge pipe 25. In this way, a pipe structure can be simplified and reduced in cost in the air compressor unit for vehicle 2. Further, since the steel pipe can be used as the discharge pipe 25 connecting the air compressor 13 and the after-cooler 17, the discharge pipe 25 can be used semipermanently or over a very long time. Therefore, the maintenance of the air compressor unit for vehicle 2 is facilitated.

[Modification]

Although one embodiment of the present invention has been described above, the present invention is not limited to the aforementioned embodiment and various changes can be made without departing from the scope of claims. For example, the following modifications may be carried out.

(1) Although the air compressor unit for vehicle including the scroll type air compressor is illustrated in the above embodiment, a configuration different from this may be adopted. For example, an air compressor unit for vehicle may be configured which includes a screw type air compressor. Further, an air compressor unit for vehicle may be configured which includes a reciprocating type air compressor to be driven by a reciprocating drive force transmitted thereto while being translated from a rotational drive force from the electric motor 14 via a crank shaft. Further, an air compressor unit may be configured which includes an oil type air compressor for compressing air using oil.

(2) Although the air compressor is arranged above and the electric motor is arranged below with the air compressor unit for vehicle installed on the vehicle in the above embodiment, a configuration different from this may be adopted. The air compressor may be arranged below and the electric motor may be arranged above with the air compressor unit for vehicle installed on the vehicle.

(3) Although the air compressor unit for vehicle including two air compressor cooling fans is illustrated in the above embodiment, a configuration different from this may be adopted. An air compressor unit for vehicle including only one air compressor cooling fan may be configured. Further, an air compressor unit for vehicle including three or more air compressor cooling fans may be configured.

(4) Although the air compression apparatus and the air compressor units for vehicle to be mounted on the vehicle are illustrated to be installed below the floor of the vehicle in the above embodiment, a configuration different from this may be adopted. The air compression apparatus and the air compressor units for vehicle may be installed on the vehicle at a position other than below the floor. For example, the air compression apparatus and the air compressor units for vehicle may be installed on the roof of the vehicle.

(5) Although an example in which the first flow passage of the first cooling unit includes the plurality of first horizontal flow passages and the second flow passage of the second cooling unit include the plurality of second horizontal flow passages is described in the above embodiment, a configuration different from this may be adopted. The first and second flow passages having a flow passage configuration other than that described in the above embodiment may be configured.

Figure 10:
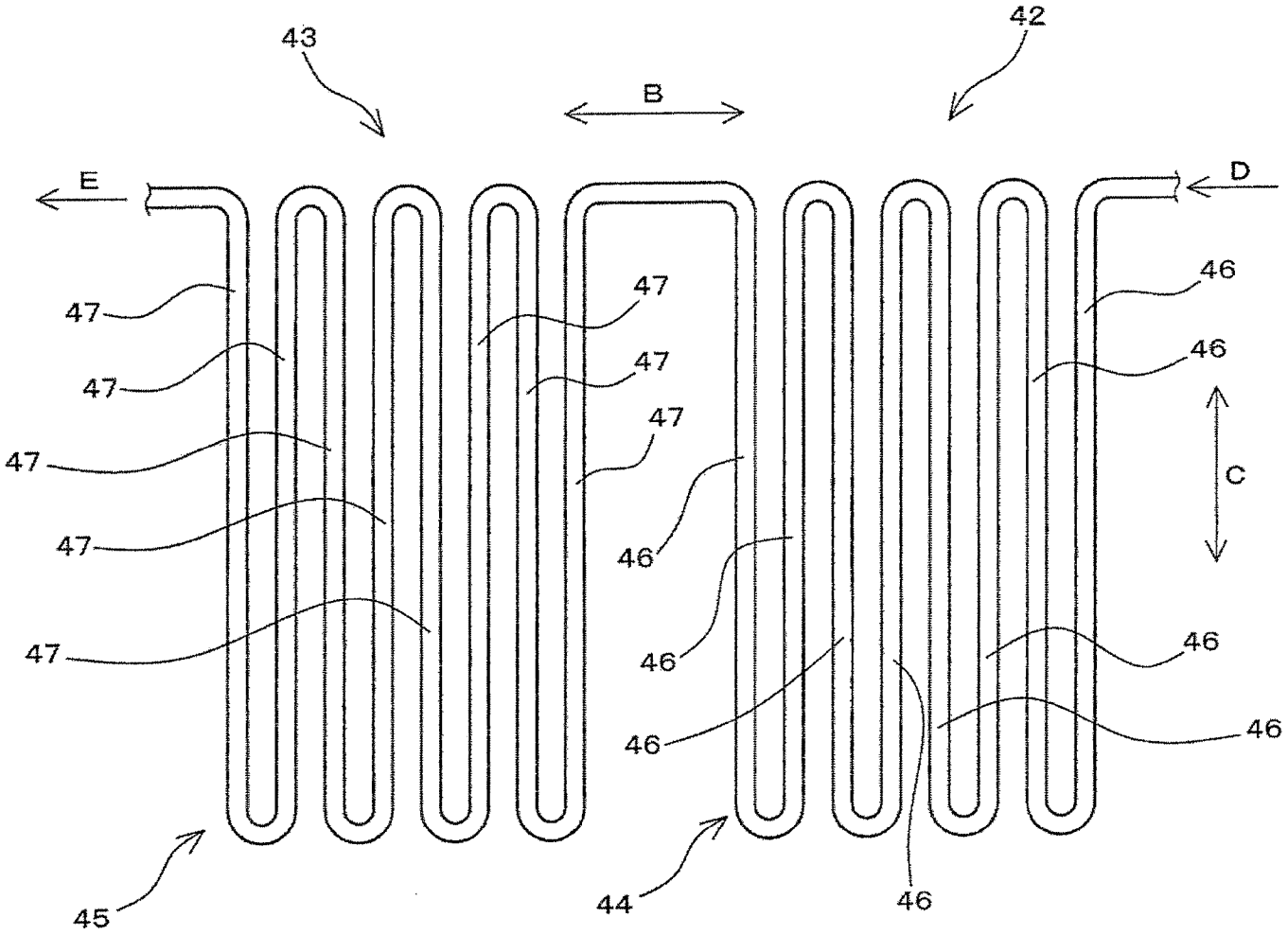
FIG. 10 is a view of a cooler according to a modification diagrammatically showing a flow passage configuration for compressed air in the cooler.

FIG. 10 is a view of an after-cooler 41 of an air compressor unit for vehicle according to a modification diagrammatically showing a flow passage configuration for compressed air in the after-cooler 41. Note that, in the following description on the modification shown in FIG. 10, elements configured as in the above embodiment in the air compressor unit for vehicle according to the modification are denoted by the same reference signs as in the above embodiment and not described.

The after-cooler 41 shown in FIG. 10 is provided as a mechanism for cooling compressed air generated in an air compressor 13. The after-cooler 41 is connected to the air compressor 13 via a discharge pipe 25. The after-cooler 41 cools the compressed air generated in the air compressor 13 and supplied via the discharge pipe 25. Further, the after-cooler 41 is mounted on a base unit 16 by being fixed to a first surface 16*a* of the base unit 16.

As shown in FIG. 10, the after-cooler 41 includes a first cooling unit 42 and a second cooling unit 43.

The first cooling unit 42 includes a first flow passage 44 in which the compressed air generated in the air compressor 13 flows. The first flow passage 44 is cooled by cooling air flow generated by air compressor cooling fans 15. The first cooling unit 42 is arranged downstream of the air compressor 13 in a flowing direction of the cooling air generated by the air compressor cooling fans 15 and blown toward the air compressor 13.

By the above configuration, the cooling air generated by the air compressor cooling fans 15 and having cooled the air compressor 13 cools the first flow passage 44 of the first cooling unit 42 from outside. Then, the compressed air flowing in the cooled first flow passage 44 is cooled by the first flow passage 44.

The second cooling unit 43 is connected to the first cooling unit 42. The second cooling unit 43 includes a second flow passage 45 into which the compressed air compressed by the air compressor 13 and cooled by the first cooling unit 42 flows. Specifically, the second flow passage 45 is connected to a downstream side of the first flow passage 44.

Further, the second cooling unit 43 is cooled by the cooling air generated by an after-cooler cooling fan 18. Specifically, the cooling air generated by the after-cooler cooling fan 18 cools the second flow passage 45 of the second cooling unit 43 from outside. Then, the compressed air flowing in the cooled second flow passage 45 is cooled by the second flow passage 45. Thus, the compressed air generated in the air compressor 13 is first cooled in the first cooling unit 42 and then in the second cooling unit 43.

Further, the first cooling unit 42 is arranged laterally to the air compressor 13 and the second cooling unit 43 is arranged laterally to the after-cooler cooling fan 18. For example, the first and second cooling units 42, 43 are arranged side by side along a horizontal direction in a state where the air compressor unit according to this modification is installed on the vehicle 100. Further, the first and second cooling units 42, 43 are arranged side by side along the horizontal direction in each of a plurality of air compressor units 2 in a state where a case unit 11 and the plurality of air compressor units 2 are installed on the vehicle 100.

As shown in FIG. 10, the first flow passage 44 includes a plurality of first vertical flow passages 46 extending along a vertical direction in the state where the air compressor unit according to this modification is installed on the vehicle 100. The first flow passage 44 is configured to meander along the vertical direction by connecting the plurality of first vertical flow passages 46 to each other.

The second flow passage 45 includes a plurality of second vertical flow passages 47 extending along the vertical direction in the state where the air compressor unit according to this modification is installed on the vehicle 100. The second flow passage 45 is configured to meander along the vertical direction by connecting the plurality of second vertical flow passages 47 to each other.

Note that the horizontal direction in the state where the air compressor unit according to this modification is installed on the vehicle 100 is shown by a line B with arrows on both ends in FIG. 10. Further, the vertical direction in the state where the air compressor unit according to this modification is installed on the vehicle 100 is shown by a line C with arrows on both ends in FIG. 10. Furthermore, a flowing direction of the compressed air flowing into the first flow passage 44 is shown by an arrow D and that of the compressed air flowing out of the second flow passage 45 is shown by an arrow E in FIG. 10.

As shown in FIG. 10, the plurality of first vertical flow passages 46 are successively connected via bent flow passages. The plurality of second vertical flow passages 47 are successively connected via bent flow passages. The plurality of first vertical flow passages 46 are arranged in a row or in a plurality of rows along the horizontal direction in the state where the air compressor unit according to this modification is installed on the vehicle 100. Similarly, the plurality of second vertical flow passages 47 are arranged in a row or in a plurality of rows along the horizontal direction in the state where the air compressor unit according to this modification is installed on the vehicle 100.

In the above modification, the first flow passage 44 that is a flow passage for the compressed air in the first cooling unit 42 is provided to meander along the vertical direction. Similarly, the second flow passage 45 that is a flow passage for the compressed air in the second cooling unit 43 is provided to meander along the vertical direction. Thus, according to this modification, a configuration for efficiently cooling the compressed air by the first and second cooling units 42, 43 can be easily realized by a simple configuration including the flow passages extending while meandering along the vertical direction.

Figure 11:
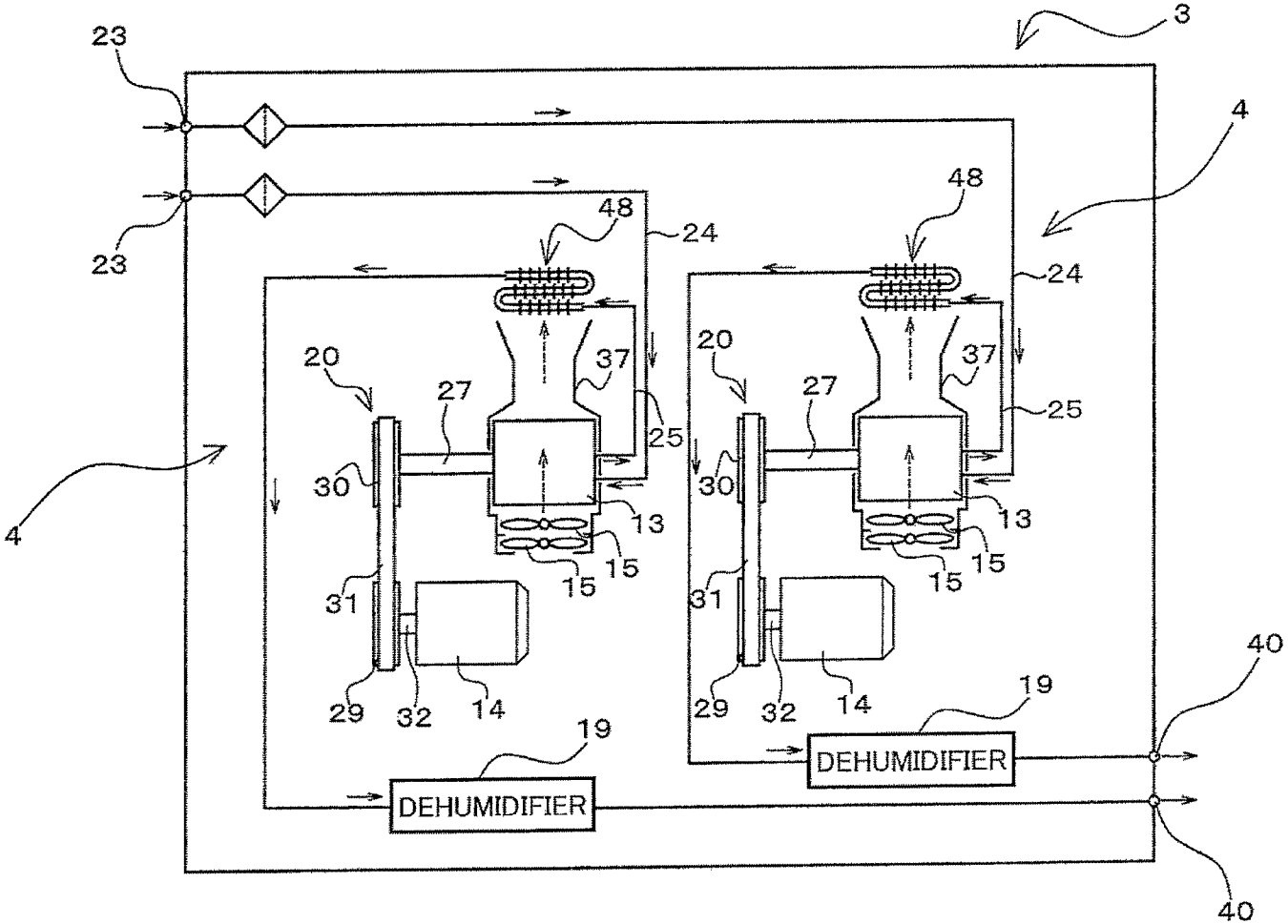
FIG. 11 is a diagram showing a system configuration of an air compression apparatus for vehicle and air compressor units for vehicle according to a modification.

(5) FIG. 11 is a diagram showing a system configuration of an air compression apparatus for vehicle 3 and air compressor units for vehicle 4 according to a modification. The air compression apparatus for vehicle 3 (hereinafter, also referred to as the "air compression apparatus 3") and the air compressor units for vehicle 4 (hereinafter, also referred to as the "air compressor units 4") shown in FIG. 11 are to be mounted on the vehicle 100. The air compressor unit 4 and the air compression apparatus 3 including a plurality of (two in this modification) air compressor units 4 are configured similarly to the air compressor unit 2 and the air compression apparatus 1 of the above embodiment. However, the air compressor unit 4 and the air compression apparatus 3 differ from the air compressor unit 2 and the air compression apparatus 1 in the absence of the after-cooler cooling fan 18, the configuration of an after-cooler 48 and operation conditions of an air compressor 13 to provide a smaller amount of heat generation.

Note that only one of the two similarly configured air compressor units 4 is described in the following description on the modification shown in FIG. 11. Further, in the following description, elements configured as in the above embodiment are denoted by the same reference signs as in the above embodiment and not described.

The air compressor unit 4 operates on operating conditions to provide a smaller amount of heat generation in the air compressor 13. Thus, the after-cooler cooling fan 18 as provided in the air compressor unit 2 is not provided. A driven pulley 30 is fixed to a rotary shaft 27 of the air compressor 13. Thus, the rotary shaft 27 of the air compressor 13 rotates together with the driven pulley 30. A drive force of an electric motor 14 is transmitted to the air compressor 13 via a drive pulley 29, a drive belt 31 and the driven pulley 30.

The after-cooler 48 is provided as a mechanism for cooling compressed air generated in the air compressor 13. The after-cooler 48 is connected to a discharge pipe 25 of the air compressor 13 and a dehumidifier 19. The after-cooler 48 cools the compressed air generated in the air compressor 13 and supplied via the discharge pipe 25.

The after-cooler 48 is arranged downstream of the air compressor 13 in a flowing direction of cooling air generated by air compressor cooling fans 15 and provided adjacent to the air compressor 13 laterally to the air compressor 13. For example, as illustrated in FIG. 11, the after-cooler 48 is arranged to face a duct 37 in which the cooling air generated by the air compressor cooling fans 15 and having cooled the air compressor 13 flows.

According to the above modification, air heated by heat generated in the air compressor 13 moves upward. Thus, by providing the after-cooler 48 laterally to the air compressor 13, the after-cooler 48 can be provided adjacent to the air compressor 13 while the influence of the heated air is suppressed to a minimum level. Therefore, the structure of the air compressor unit for vehicle 4 as a whole can be compacted and an installation area can be drastically reduced. Further, since the after-cooler cooling fan 18 as in the above embodiment is not necessary according to the above modification, the structure of the air compressor unit for vehicle 4 as a whole can be compacted and the installation area can be drastically reduced. Note that the number of components can be reduced and low noise and noise reduction can be realized by actively omitting the after-cooler cooling fan 18 as used in the above embodiment when the amount of heat generation in the air compressor 13 is small as in this modification.

Here, the above embodiment is outlined.

(1) An air compressor unit for vehicle according to the above embodiment is an air compressor unit for vehicle to be mounted on a vehicle and includes an air compressor for compressing sucked air and an electric motor for driving the air compressor. The air compressor and the electric motor are arranged one above the other.

In this configuration, the air compressor unit for vehicle is so installed on the vehicle that the air compressor and the electric motor are arranged along the vertical direction. Thus, it is efficiently suppressed that an installation area necessary in installing the air compressor unit for vehicle on the vehicle becomes long and wide. In this way, an increase of the installation area of the air compressor unit for vehicle on the vehicle is suppressed. Further, an increase of an installation area in installing a plurality of air compressor units for vehicle on the vehicle is also suppressed.

Thus, according to the above configuration, it is possible to provide an air compressor unit for vehicle capable of suppressing an increase of an installation area on a vehicle. Since the increase of the installation area on the vehicle is suppressed according to the above configuration, a degree of freedom in rigging the air compressor unit for vehicle on the vehicle can be improved. Note that a configuration for arranging the air compressor and the electric motor one above the other is not limited to the one for arranging the air compressor and the electric motor along one vertically extending straight line. A configuration for arranging the air compressor and the electric motor along the vertical direction with the air compressor and the electric motor shifted from each other with respect to one vertically extending straight line, i.e. with the air compressor and the electric motor offset is also included.

(2) The air compressor unit for vehicle preferably further includes an after-cooler for cooling compressed air generated in the air compressor and an after-cooler cooling fan for generating cooling air flow for the after-cooler by being driven by a drive force of the electric motor.

In this configuration, the after-cooler cooling fan for generating the cooling air flow for the after-cooler is driven by the drive force of the electric motor. Thus, it is not necessary to separately provide a drive source for the after-cooler cooling fan. Therefore, the structure of the air compressor unit for vehicle as a whole can be compacted and the installation area can be drastically reduced.

(3) In the above air compressor unit for vehicle, the air compressor is preferably arranged adjacent to an air suction side of the after-cooler cooling fan.

According to this configuration, the after-cooler cooling fan generates an air flow around the air compressor in sucking surrounding air. As a result, the air compressor is cooled. Thus, a configuration for cooling the air compressor can be realized by a compact structure. Then, the structure of the air compressor unit for vehicle as a whole can be compacted and the installation area can be drastically reduced.

(4) In the above air compressor unit for vehicle, a rotary shaft of the after-cooler cooling fan and a rotary shaft of the air compressor are preferably coaxially provided.

According to this configuration, a power transmission mechanism such as a gear is not necessary since the rotary shaft of the after-cooler cooling fan and that of the air compressor are coaxially provided. Thus, the structure of the air compressor unit for vehicle as a whole can be compacted and the installation area can be drastically reduced.

(5) In the above air compressor unit for vehicle, the after-cooler cooling fan is preferably a centrifugal blower.

According to this configuration, the after-cooler cooling fan is configured as the centrifugal blower capable of easily generating a large air flow. Thus, the after-cooler can be efficiently cooled by the after-cooler cooling fan as the centrifugal blower. By being able to efficiently cool the after-cooler, the compressed air generated in the air compressor can be efficiently cooled.

Further, if the rotary shafts of the after-cooler cooling fan as the centrifugal blower and the air compressor are coaxially provided, the after-cooler can be arranged laterally to, above or below the after-cooler cooling fan and the air compressor. In this case, a duct for guiding the cooling air from the after-cooler cooling fan to the after-cooler can be shortened in length. In this way, the structure of the air compressor unit for vehicle as a whole can be compacted and the installation area can be drastically reduced.

(6) The above air compressor unit for vehicle may further include an after-cooler for cooling the compressed air generated in the air compressor. In this case, the after-cooler is preferably provided laterally to the air compressor.

Air heated by heat generated in the air compressor moves upward. By providing the after-cooler laterally to the air compressor, the after-cooler can be provided adjacent to the air compressor while the influence of the heated air is suppressed to a minimum level. Therefore, the structure of the air compressor unit for vehicle as a whole can be compacted and the installation area can be drastically reduced.

(7) The above air compressor unit for vehicle may further include an air compressor cooling fan provided laterally to the air compressor and configured to cool the air compressor. In this case, the air compressor cooling fan is preferably configured as an axial fan.

According to this configuration, the air compressor cooling fan is configured as the axial fan provided laterally to the air compressor. The axial fan is configured as a fan smaller in size than the centrifugal blower. Thus, even if a space for installing the air compressor cooling fan in the air compressor unit for vehicle is narrow, the air compressor cooling fan can be easily installed. Further, the miniaturization of the air compressor unit for vehicle including the air compressor cooling fan can be realized.

(8) The above air compressor unit for vehicle may further include an after-cooler for cooling the compressed air generated in the air compressor and an after-cooler cooling fan configured as a centrifugal blower to be driven by a drive force of the electric motor and configured to generate cooling air flow for the after-cooler. In this case, the after-cooler may include a first cooling unit having a first flow passage in which the compressed air generated in the air compressor flows and which is cooled by the cooling air flow generated by the air compressor cooling fan and a second cooling unit having a second flow passage into which the compressed air cooled in the first cooling unit flows and configured to be cooled by the cooling air flow generated by the after-cooler cooling fan. Preferably, the first cooling unit is arranged laterally to the air compressor and the second cooling unit is arranged laterally to the after-cooler cooling fan.

According to this configuration, the compressed air generated in the air compressor and having a relatively high temperature is cooled in the first cooling unit. At this time, the first cooling unit is cooled by the cooling air coming from the air compressor cooling fan, which is the axial fan, and having a relatively high temperature after having cooled the air compressor. Subsequently the compressed air cooled in the first cooling unit is further cooled in the second cooling unit. At this time, the second cooling unit is cooled by the cooling air having a lower temperature than that from the after-cooler cooling fan that is the centrifugal blower. Thus, cooling by the cooling air from the air compressor cooling fan and cooling by the cooling air from the after-cooler cooling fan are successively performed in this order and the compressed air is efficiently cooled. Further, according to the above configuration, the first cooling unit is arranged laterally to the air compressor and the second cooling unit is arranged laterally to the after-cooler cooling fan. Thus, the air compressor, the after-cooler cooling fan and the after-cooler can be arranged in a compact manner. Furthermore, according to the above configuration, the cooling air from the axial fan for cooling the air compressor can be used to cool the after-cooler. Thus, the miniaturization of the after-cooler cooling fan can also be realized by setting cooling performance of the after-cooler cooling fan low. These enable the structure of the air compressor unit for vehicle to be compacted and the installation area to be drastically reduced.

Note that if a flow passage configuration of the after-cooler is such that cooling by the cooling air flow from the air compressor cooling fan and cooling by the cooling air from the after-cooler cooling fan are alternately repeated, a state may occur where the compressed air temporarily cooled is warmed and cooled again. In this case, cooling efficiency in cooling the compressed air may be reduced. However, according to the above configuration, the compressed air can be efficiently cooled since there is no possibility of causing such a reduction in cooling efficiency.

(9) In the above air compressor unit for vehicle, the first flow passage is provided to meander along a horizontal direction in a state where the air compressor unit for vehicle is installed on the vehicle and the second flow passage is provided to meander along the horizontal direction in the state where the air compressor unit for vehicle is installed on the vehicle.

According to this configuration, the first flow passage that is a flow passage for the compressed air in the first cooling unit is provided to meander along the horizontal direction. Similarly, the second flow passage that is a flow passage for the compressed air in the second cooling unit is also provided to meander along the horizontal direction. Thus, according to the above configuration, water droplets easily flow in the flow passage and are easily discharged to a downstream side even if dew condensation occurs in the flow passage and water droplets are produced in the flow passage. Thus, a configuration capable of suppressing the remaining of water droplets in the flow passage can be easily realized by a simple structure in the first and second cooling units.

(10) In the air compressor unit for vehicle, the first flow passage is provided to meander along a vertical direction in the state where the air compressor unit for vehicle is installed on the vehicle and the second flow passage is provided to meander along the vertical direction in the state where the air compressor unit for vehicle is installed on the vehicle.

According to this configuration, the first flow passage that is a flow passage for the compressed air in the first cooling unit is provided to meander along the vertical direction. Similarly, the second flow passage that is a flow passage for the compressed air in the second cooling unit is also provided to meander along the vertical direction. Thus, according to the above configuration, a configuration for efficiently cooling the compressed air by the first and second cooling units can be easily realized by a simple configuration including the flow passages extending while meandering along the vertical direction.

(11) The air compressor unit for vehicle may further include a controller for controlling the drive of the electric motor. In this case, the controller is preferably arranged laterally to the electric motor.

According to this configuration, the air compressor and the electric motor are arranged along the vertical direction and the controller for the electric motor is arranged laterally to the electric motor. Thus, the controller can be arranged at a distance from the air compressor and it can be suppressed that the controller is affected by heat generated in the air compressor. Further, the electric motor and the controller can be proximately arranged. Therefore, the structure can be compacted by proximately arranging the electric motor and the controller while the air compressor and the controller are thermally separated.

According to the present invention, it is possible to provide an air compressor unit for vehicle capable of suppressing an increase of an installation area on a vehicle.

The present invention can be widely applied to air compressor units for vehicle to be mounted on vehicles.

This application is based on Japanese Patent application No. 2014-101848 filed in Japan Patent Office on May 15, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An air compressor unit configured to be mounted on a vehicle, the air compressor unit comprising:

an air compressor for compressing sucked air;

an electric motor for driving the air compressor;

an after-cooler for cooling compressed air generated in the air compressor;

an after-cooler cooling fan for generating cooling air flow for the after-cooler; and an air compressor cooling fan for cooling the air compressor;

wherein the after-cooler includes:

a first cooling unit having a first flow passage into which the compressed air generated in the air compressor flows and configured to be cooled by cooling air flow generated by the air compressor cooling fan flowing in contact with the first cooling unit; and a second cooling unit having a second flow passage into which the compressed air cooled in the first cooling unit flows and configured to be cooled by the cooling air flow generated by the after-cooler cooling fan, wherein the second cooling unit is configured to cause direct heat exchange between the compressed air and the cooling air flow generated by the after-cooler cooling fan flowing in contact with the second cooling unit so as to further cool the compressed air, wherein the air compressor cooling fan is configured as an axial fan, and wherein the first cooling unit and the air compressor are arranged on an extension line of a rotary shaft of the air compressor cooling fan.

2. An air compressor unit according to claim 1, wherein the after-cooler cooling fan is driven by a drive force of the electric motor.

3. An air compressor unit according to claim 2, wherein the air compressor is arranged adjacent to an air suction side of the after-cooler cooling fan.

4. An air compressor unit according to claim 3, wherein a rotary shaft of the after-cooler cooling fan and a rotary shaft of the air compressor are coaxially provided.

5. An air compressor unit according to claim 4, wherein the after-cooler cooling fan is a centrifugal blower.

6. An air compressor unit according to claim 1, wherein the after-cooler is provided laterally to the air compressor.

7. An air compressor unit according to claim 1, wherein the air compressor cooling fan is provided laterally to the air compressor.

8. An air compressor unit according to claim 6, wherein the after-cooler cooling fan is configured as a centrifugal blower to be driven by a drive force of the electric motor, and wherein the first cooling unit is arranged laterally to the air compressor and the second cooling unit is arranged laterally to the after-cooler cooling fan.

9. An air compressor unit according to claim 8, wherein the first flow passage is provided to meander along a horizontal direction in a state where the air compressor unit for vehicle is installed on the vehicle; and wherein the second flow passage is provided to meander along the horizontal direction in the state where the air compressor unit for vehicle is installed on the vehicle.

10. An air compressor unit according to claim 8, wherein the first flow passage is provided to meander along a vertical direction in a state where the air compressor unit for vehicle is installed on the vehicle; and wherein the second flow passage is provided to meander along the vertical direction in the state where the air compressor unit for vehicle is installed on the vehicle.

11. An air compressor unit according to claim 1, further comprising:

a base member to which the air compressor and the electric motor are mounted; and a controller for controlling the drive of the electric motor, wherein the controller is arranged at a side opposite to a side where the air compressor is arranged with respect to the base member, and wherein the controller is arranged laterally to the electric motor.

12. An air compressor unit according to claim 1, wherein the air compressor and the electric motor are arranged one above the other.

13. An air compressor unit according to claim 11, wherein the air compressor and the electric motor are separately arranged above and below the base member.

* * * * *